US011232808B2

(12) United States Patent
Ma et al.

(10) Patent No.: US 11,232,808 B2
(45) Date of Patent: *Jan. 25, 2022

(54) ADJUSTING SPEED OF HUMAN SPEECH PLAYBACK

(71) Applicant: Amazon Technologies, Inc., Seattle, WA (US)

(72) Inventors: Zhaoqing Ma, Sammamish, WA (US); Tony Roy Hardie, Seattle, WA (US); Christo Frank Devaraj, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/394,717

(22) Filed: Apr. 25, 2019

(65) Prior Publication Data

US 2019/0318758 A1 Oct. 17, 2019

Related U.S. Application Data

(63) Continuation of application No. 15/677,659, filed on Aug. 15, 2017, now Pat. No. 10,276,185.

(51) Int. Cl.

| | |
|---|---|
| ***G10L 21/04*** | (2013.01) |
| ***G10L 25/78*** | (2013.01) |
| *G10L 25/27* | (2013.01) |

(52) U.S. Cl.

CPC ..... *G10L 21/04* (2013.01); *G10L 25/78* (2013.01); *G10L 25/27* (2013.01)

(58) Field of Classification Search

USPC ..... 704/200–232, 500–504

See application file for complete search history.

(56) References Cited

U.S. PATENT DOCUMENTS

| | | | | |
|---|---|---|---|---|
| 6,801,894 | B2 * | 10/2004 | Nakamura | G10L 13/047 704/215 |
| 10,276,185 | B1 * | 4/2019 | Ma | G10L 21/04 |
| 2002/0010916 | A1 * | 1/2002 | Thong | H04N 5/278 725/1 |
| 2002/0038209 | A1 * | 3/2002 | Brandel | G10L 21/04 704/207 |
| 2004/0267524 | A1 * | 12/2004 | Boillot | G10L 21/04 704/205 |

(Continued)

*Primary Examiner* — Jesse S Pullias

(74) *Attorney, Agent, or Firm* — Pierce Atwood LLP

(57) ABSTRACT

A system configured to vary a speech speed of speech represented in input audio data without changing a pitch of the speech. The system may vary the speech speed based on a number of different inputs, including non-audio data, data associated with a command, or data associated with the voice message itself. The non-audio data may correspond to information about an account, device or user, such as user preferences, calendar entries, location information, etc. The system may analyze audio data associated with the command to determine command speech speed, identity of person listening, etc. The system may analyze the input audio data to determine a message speech speed, background noise level, identity of the person speaking, etc. Using all of these inputs, the system may dynamically determine a target speech speed and may generate output audio data having the target speech speed.

19 Claims, 16 Drawing Sheets

(56) References Cited

U.S. PATENT DOCUMENTS

| | | | | |
|---|---|---|---|---|
| 2005/0131684 | A1* | 6/2005 | Clelland | G10L 15/22 704/231 |
| 2006/0293883 | A1* | 12/2006 | Endo | G10L 21/04 704/219 |
| 2008/0065387 | A1* | 3/2008 | Cross, Jr. | G10L 15/22 704/270 |
| 2008/0140391 | A1* | 6/2008 | Yen | G10L 21/01 704/200 |
| 2012/0310652 | A1* | 12/2012 | O'Sullivan | G06F 3/167 704/270.1 |
| 2013/0325456 | A1* | 12/2013 | Takagi | G10L 21/043 704/210 |
| 2015/0162000 | A1* | 6/2015 | Di Censo | G06F 16/433 704/270.1 |
| 2015/0287403 | A1* | 10/2015 | Holzer Zaslansky | G06T 13/205 704/231 |
| 2017/0064244 | A1* | 3/2017 | Abou Mahmoud | G11B 27/005 |
| 2017/0270965 | A1* | 9/2017 | Bao | G06F 16/35 |

* cited by examiner

ADJUSTING SPEED OF HUMAN SPEECH PLAYBACK

CROSS-REFERENCE TO RELATED APPLICATION

This application is a continuation of, and claims the benefit of, U.S. Non-provisional patent application Ser. No. 15/677,659, filed Aug. 15, 2017, and entitled "ADJUSTING SPEED OF HUMAN SPEECH PLAYBACK", and scheduled to issue on Apr. 30, 2019 as U.S. Pat. No. 10,276,185, which is expressly incorporated herein by reference in its entirety.

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture and process audio data that includes speech. The audio data may be sent as a voice message or as part of a communication session, such as a voice over internet protocol (VoIP) telephone call, a videoconference or the like. The speech may be difficult to understand for a number of reasons, such as being too fast or too slow, the talker having an accent, variations in loudness of different words or sentences, presence of background noise, or the like. Sometimes, only a portion of the speech is difficult to understand, such as important information corresponding to a name, an address, a phone number or the like. The audio data may be processed to improve playback, which includes speeding up or slowing down the speech represented in the audio data without shifting a pitch of the speech. Thus, during playback of the voice message or the communication session (e.g., on the receiving side), a modified speech speed may be faster or slower than an original speech speed. However, choosing an undesired speech speed may negatively impact playback of the audio data, and the desired speech speed may vary throughout the voice message and/or communication session.

To improve playback of the audio data, devices, systems and methods are disclosed that perform normalization of human speech playback and dynamically adjust a target speech speed. For example, the system may dynamically adjust the target speech speed based on a number of inputs associated with input audio data, including non-audio data (e.g., input data), data associated with a command (e.g., command speech data), or data associated with the voice message itself (e.g., message speech data). The input data may correspond to information about an account, device or user, such as user preferences, calendar entries, location information, or the like. The system may analyze audio data associated with the command to determine the command speech data (e.g., command speech speed, identity of person listening, etc.) and/or may analyze the input audio data to determine the message speech data (e.g., message speech speed, background noise level, identity of the person speaking, etc.). Using all of these inputs, the system may dynamically determine a target speech speed and may generate output audio data having the target speech speed. In some examples, the system may adjust portions of the input audio data to have different target speech speeds, add additional pauses, adjust a volume of the speech, separate speech associated with different people, determine different target speech speeds for the different people, or the like. The system may adjust a speed of human speech playback on voice messages and/or communication sessions (e.g., VoIP telephone calls, video conversations or the like) without departing from the disclosure.

Figure 1:
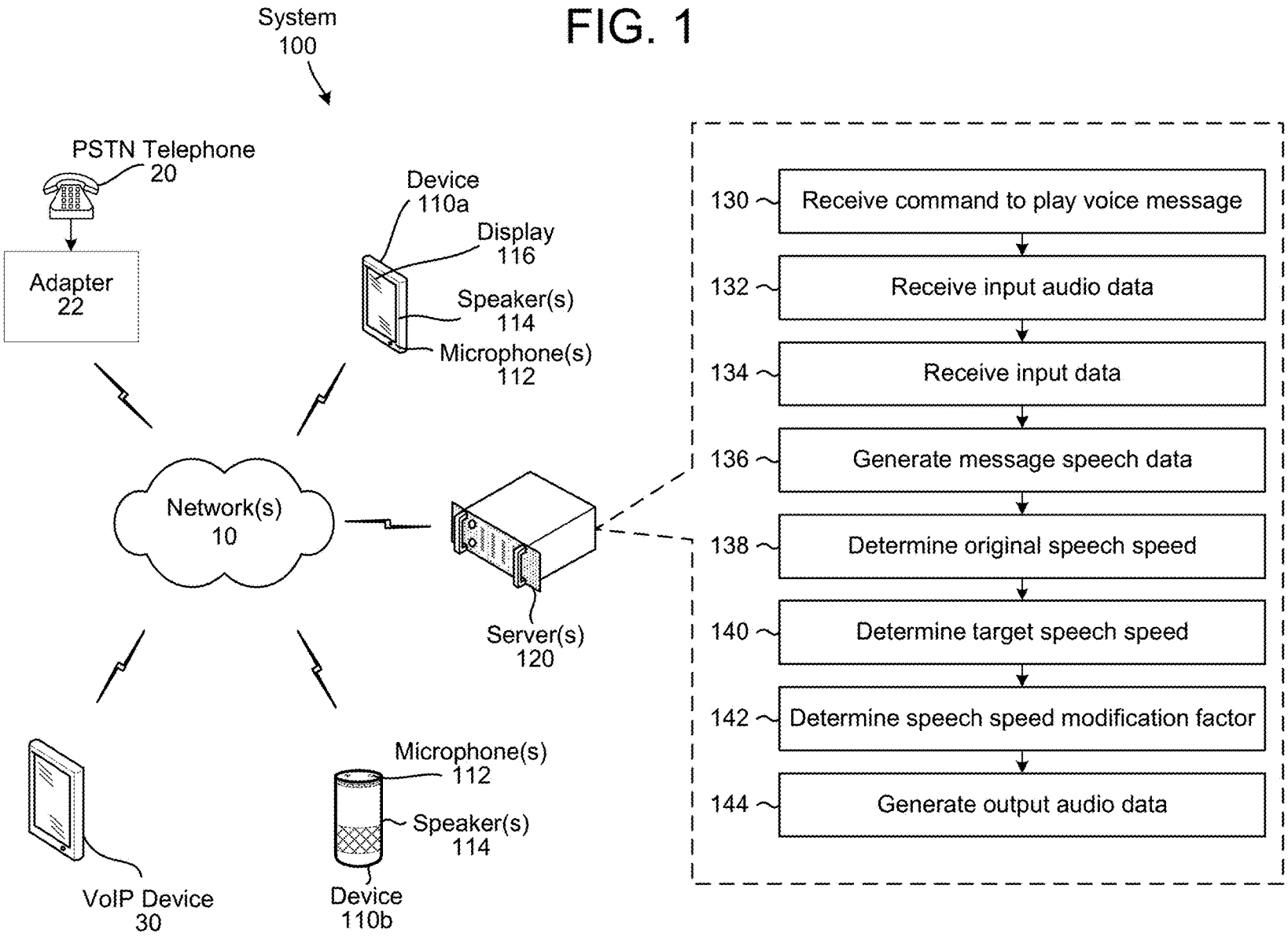
FIG. 1 illustrates a system according to embodiments of the present disclosure.

FIG. 1 illustrates a high-level conceptual block diagram of a system 100 configured to adjust a speed of human speech playback. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a Voice over Internet Protocol (VoIP) device 30, a public switched telephone network (PSTN) telephone 20 connected to an adapter 22, a first device 110*a*, a second device 110*b* and/or a server(s) 120, which may all be communicatively coupled to network(s) 10.

The VoIP device 30, the PSTN telephone 20, the first device 110*a* and/or the second device 110*b* may communicate with the server(s) 120 via the network(s) 10. For example, one or more of the VoIP device 30, the PSTN telephone 20, the first device 110*a* and the second device 110*b* may send audio data to the server(s) 120 via the network(s) 10, such as a voice message or audio during a communication session. While not illustrated in FIG. 1, the audio data may be associated with video data (e.g., video message, video communication session, etc.) without departing from the disclosure.

The VoIP device 30 may be an electronic device configured to connect to the network(s) 10 and to send and receive data via the network(s) 10, such as a smart phone, tablet or the like. Thus, the VoIP device 30 may send audio data to and/or receive audio data from the server(s) 120, either during a VoIP communication session or as a voice message. In contrast, the PSTN telephone 20 may be a landline telephone (e.g., wired telephone, wireless telephone or the like) connected to the PSTN (not illustrated), which is a landline telephone network that may be used to communicate over telephone wires, and the PSTN telephone 20 may not be configured to directly connect to the network(s) 10. Instead, the PSTN telephone 20 may be connected to the adapter 22, which may be configured to connect to the PSTN and to transmit and/or receive audio data using the PSTN and configured to connect to the network(s) 10 (using an Ethernet or wireless network adapter) and to transmit and/or receive data using the network(s) 10. Thus, the PSTN telephone 20 may use the adapter 22 to send audio data to and/or receive audio data from the second device 110*b* during either a VoIP communication session or as a voice message.

The first device 110*a* and the second device 110*b* may be electronic devices configured to send audio data to and/or receive audio data from the server(s) 120. The device(s) 110 may include microphone(s) 112, speakers 114, and/or a display 116. For example, FIG. 1 illustrates the second device 110*b* including the microphone(s) 112 and the speakers 114, while the first device 110*a* includes the microphone(s) 112, the speakers 114 and the display 116. While the second device 110*b* is illustrated as a speech-controlled device without the display 116, the disclosure is not limited thereto and the second device 110*b* may include the display 116 without departing from the disclosure. Using the microphone(s) 112, the device(s) 110 may capture audio data and send the audio data to the server(s) 120.

While the server(s) 120 may receive audio data from multiple devices, for ease of explanation the disclosure illustrates the server(s) 120 receiving audio data from a single device at a time. For example, a first user may be associated with one of the VoIP device 30, the PSTN telephone 20, or the first device 110*a* and may send audio data to a second user associated with the second device 110*b*. In some examples, the audio data is associated with a one way exchange (e.g., voice message), such that the first device 110*a* sends the audio data to the server(s) 120 at a first time and the second device 110*b* receiving the audio data from the server(s) 120 at a second time, with a gap between the first time and the second time not corresponding to processing and/or networking delays. In other examples, the audio data may be associated with a two-way exchange, such as a real-time communication session (e.g., VoIP telephone conversation, video conversation or the like) in which the first device 110*a* sends the audio data to the server(s) 120 and the second device 110*b* receives the audio data from the server(s) 120 at roughly the same time, after slight processing and/or networking delays.

The server(s) 120 may be configured to receive input audio data and adjust a speed of human speech playback of the input audio data, as will be discussed in greater detail below, prior to sending output audio data to the second device 110*b* for playback. For example, the server(s) 120 may process the input audio data to improve playback, which includes speeding up or slowing down speech represented in the input audio data without shifting a pitch of the speech. Thus, a modified speech speed represented in the output audio data may be faster or slower than an original speech speed represented in the input audio data.

As used herein, "speech speed" (e.g., rate of speed associated with speech included in audio data) refers to a speech tempo, which is a measure of the number of speech units of a given type produced within a given amount of time. Speech speed may be measured using words per minute (wpm) or syllables per second (syl/sec), although the disclosure is not limited thereto. For example, the server(s) 120 may identify portions of the audio data that correspond to individual words and may determine the rate of speed of speech by determining a number of words spoken per minute. Additionally or alternatively, the server(s) 120 may identify portions of the audio data that correspond to individual syllables and may determine the rate of speed of speech by determining a number of syllables spoken per second. An original speech speed refers to the rate of speed at which the original speaker was talking, whereas a target speech speed refers to the rate of speed that is output by the server(s) 120 after adjustment. For example, the server(s) 120 may determine an original speech speed (e.g., 100 words per minute, or wpm) associated with first audio data, determine a target speech speed (e.g., 150 wpm) and may modify the first audio data to generate second audio data having the target speech speed.

The server(s) 120 may determine a target speech speed based on a number of inputs associated with the input audio data. For example, the server(s) 120 may dynamically adjust the target speech speed based on non-audio data (e.g., input data), data associated with a command (e.g., command speech data), or data associated with the voice message itself (e.g., message speech data), which will be discussed in greater detail below with regard to FIGS. 3A-3D. The input data may correspond to information about an account, device and/or user, such as user preferences (e.g., playback speed preferences) based on a user profile associated with the user, calendar entries (e.g., calendar data), location information (e.g., location data), or the like. The server(s) 120 may analyze audio data associated with the command to determine the command speech data (e.g., command speech speed, identity of person listening, etc.) and/or may analyze the input audio data to determine the message speech data (e.g., message speech speed, background noise level, identity of the person speaking, etc.).

Using all of these inputs, the server(s) 120 may dynamically determine a target speech speed and may generate output audio data having the target speech speed. In some examples, the server(s) 120 may adjust portions of the input audio data to have different target speech speeds, add additional pauses, adjust a volume of the speech, separate speech associated with different people, determine different target speech speeds for the different people, or the like, without departing from the disclosure.

To determine the target speech speed, a speech speed modification component in the server(s) 120 and/or the device 110 may implement one or more machine learning models. For example, the input data, the command speech data, and/or the message speech data may be input to the speech speed modification component, which outputs the target speech speed. A ground truth may be established for purposes of training the one or more machine learning models. In machine learning, the term "ground truth" refers to the accuracy of a training set's classification for supervised learning techniques.

Various machine learning techniques may be used to train and operate the speech speed modification component. Such techniques may include backpropagation, statistical learning, supervised learning, semi-supervised learning, stochastic learning, or other known techniques. Such techniques may more specifically include, for example, neural networks (such as deep neural networks and/or recurrent neural networks), inference engines, trained classifiers, etc. Examples of trained classifiers include Support Vector Machines (SVMs), neural networks, decision trees, AdaBoost (short for "Adaptive Boosting") combined with decision trees, and random forests. Focusing on SVM as an example, SVM is a supervised learning model with associated learning algorithms that analyze data and recognize patterns in the data, and which are commonly used for classification and regression analysis. Given a set of training examples, each marked as belonging to one of two categories, an SVM training algorithm builds a model that assigns new examples into one category or the other, making it a non-probabilistic binary linear classifier. More complex SVM models may be built with the training set identifying more than two categories, with the SVM determining which category is most similar to input data. An SVM model may be mapped so that the examples of the separate categories are divided by clear gaps. New examples are then mapped into that same space and predicted to belong to a category based on which side of the gaps they fall on. Classifiers may issue a "score" indicating which category the data most closely matches. The score may provide an indication of how closely the data matches the category. The user response to content output by the system may be used to further train the machine learning model(s).

As illustrated in FIG. 1, the server(s) 120 may receive (130) a command to play a voice message and may receive (132) input audio data corresponding to the voice message. For example, the server(s) 120 may receive a command from the second device 110*b* instructing the server(s) 120 to send the voice message to the second device 110*b* for playback. Additionally or alternatively, the server(s) 120 may receive command audio data from the second device 110*b* and may perform automatic speech recognition (ASR), natural language understanding (NLU) or the like to determine that the command audio data corresponds to a command instructing the server(s) 120 to send the voice message to the second device 110*b* for playback.

The server(s) 120 may receive (134) input data associated with the command. The input data may be non-audio data that corresponds to information about an account, the second device 110*b* and/or user, such as user preferences, calendar entries, location information or the like. The input data is not determined based on the command audio data or the message audio data, but is received from the second device 110*b* and/or from a database associated with the account, the second device 110*b* and/or the user. While examples of the input data are illustrated in FIG. 3B, the disclosure is not limited thereto and the input data may include any information that the server(s) 120 may use to determine a target speech speed and/or adjust a speed of human speech playback.

The server(s) 120 may generate (136) message speech data based on the input audio data. The message speech data is associated with speech represented in the input audio data. For example, the server(s) 120 may analyze the input audio data to determine information such as a message speech speed, background noise level, identity of the person speaking, and/or the like. Thus, whereas the input data is information associated with the account, the second device 110*b* and/or the user (e.g., based on a user profile associated with the user), the message speech data refers to information derived from the input audio data itself, as will be discussed in greater detail below with regard to FIG. 3D.

The server(s) 120 may determine (138) an original speech speed (e.g., message speech speed). In some examples, the server(s) 120 may determine different original speech speeds associated with different portions of the input audio data, such as when the user speeds up or slows down while leaving the voice message. In some examples, the server(s) 120 determine the original speech speed as part of generating the message speech data and step 138 refers to identifying the original speech speed associated with a portion of the input audio data that is currently being processed by the server(s) 120. However, the disclosure is not limited thereto and the server(s) 120 may determine the original speech speed separately from determining the message speech data without departing from the disclosure.

The server(s) 120 may determine (140) a target speech speed based on the input data and the message speech data, may determine (142) a speech speed modification factor (e.g., speech speed modification variable) based on the original speech speed and the target speech speed and may generate (144) output audio data using the speech speed modification factor. In some examples, the server(s) 120 may determine the target speech speed in words per minute (wpm) and may divide the target speech speed by the original speech speed to determine the speech speed modification factor. For example, if the target speech speed is 120 wpm and the original speech speed is 100 wpm, the speech speed modification factor is equal to 1.2× (e.g., second speech speed associated with the output audio data is 1.2 times faster than a first speech speed associated with the input audio data). Similarly, if the target speech speed is 120 wpm and the original speech speed is 150 wpm, the speech speed modification factor is equal to 0.8× (e.g., second speech speed associated with the output audio data is 0.8 times as fast as the first speech speed associated with the input audio data).

In the examples illustrated above, the server(s) 120 determines a speech speed modification factor (e.g., multiplier), such as 1.2× or 0.8×. The server(s) 120 may determine the speech speed modification factor by dividing the target speech speed by the original speech speed. For ease of explanation, the disclosure will refer to determining and applying a speech speed modification factor to adjust a speech speed. However, the disclosure is not limited to determining a multiplier and the server(s) 120 may instead determine a speech speed modification variable without departing from the disclosure. Thus, any reference to a speech speed modification factor may instead refer to a speech speed modification variable without departing from the disclosure. A speech speed modification variable indicates a relationship between the target speech speed and the original speech speed, enabling the server(s) 120 to achieve the target speech speed by applying the speech speed modification variable to the input audio data. Thus, the server(s) 120 may modify the input audio data using the speech speed modification variable to generate the output audio data.

The server(s) 120 may take into consideration a number of different criteria in determining the target speech speed. In some examples, the server(s) 120 may associate a target speech speed with an identity. For example, the server(s) 120 may detect the identity in the message speech data (e.g., identity of the person speaking in the voice message) and may determine the target speech speed based on previous settings or user preferences associated with the identity (e.g., person speaks fast and the target speech speed should be slower). Additionally or alternatively, the server(s) 120 may determine that the identity is associated with the command (e.g., identity of the listener) and may determine the target speech speed based on previous settings or user preferences associated with the listener (e.g., listener prefers speeding up voice messages).

In some examples, the server(s) 120 may determine the target speech speed based on an estimated urgency. For example, the server(s) 120 may determine a range of values for the target speech speed and use the estimated urgency to select from within the range of values. The server(s) 120 may determine the estimated urgency based on the input data (e.g., calendar entries, location information of listener, number of voice messages, etc.) and/or the command speech data (e.g., speech speed of request for playback of voice messages, content analysis of the request, etc.). For example, if the listener requests voice messages en route to a location (e.g., almost to work or home) and/or prior to an upcoming calendar event, the server(s) 120 may determine that the estimated urgency is high and may increase the target speech speed. Additionally or alternatively, if the speech speed of the request for playback of voice messages is fast and/or the number of voice messages is high, the server(s) 120 may determine that the estimated urgency is high and may increase the target speech speed. Similarly, if the server(s) 120 detects an incoming communication (e.g., telephone call, communication session, etc.) or the presence of a guest (e.g., identifying an additional person speaking in the command audio data, detecting an additional face using facial recognition, etc.), the server(s) 120 may determine that the estimated urgency is high and may increase the target speech speed.

The server(s) 120 may determine the target speech speed based on presence information associated with the listener and/or guests. For example, as mentioned above, the server(s) 120 may determine that a new guest has arrived using facial recognition or the like and may increase the target speech speed accordingly. Additionally or alternatively, the server(s) 120 may determine that the listener walked away from the second device 110*b* during playback of the voice message or during a communication session (e.g., presence is no longer detected) and may pause or decrease the target speech speed until the listener returns to the second device 110*b* (e.g., presence is detected again). Once the listener returns to the second device 110*b*, the server(s) 120 may increase the target speech speed until the listener is caught up, at which point the server(s) 120 may return to a normal target speech speed. Thus, the listener may walk away from a communication session and/or voice message and come back without missing anything, with playback at an accelerated rate for a period of time after the listener returns.

In some examples, the server(s) 120 may determine the target speech speed based on an explicit command from the listener. For example, the listener may indicate in the command (e.g., command audio data) a desired speech speed or may input a follow up command to increase or decrease the target speech speed. Additionally or alternatively, the server(s) 120 may infer that the target speech speed should be increased or decreased based on other commands. For example, if the listener requests the same voice message to be repeated, the server(s) 120 may decrease the target speech speed for subsequent playback.

In some examples, the server(s) 120 may determine the target speech speed based on cues included in the input data and/or detected in the command audio data. For example, the input data may include an indication or notification from a companion device (e.g., smartphone, computer, etc.) that the listener is typing and may decrease the target speech speed accordingly. Additionally or alternatively, the server(s) 120 may detect typing in the command audio data (e.g., detect sound associated with a keyboard) and may decrease the target speech speed accordingly. However, the disclosure is not limited thereto and the server(s) 120 may detect cues based on image data (e.g., video during a video communication session, image data captured by the second device 110*b*, etc.), such as detecting that the listener is typing or writing something down or just that the listener is located in proximity to a keyboard or the like.

In some examples, the server(s) 120 may determine the target speech speed based on information received from other devices. As discussed above, the input data may include a notification from a companion device that the listener is typing. In addition, the companion device may send a notification if the listener is watching a video, scrolling through a website, email or document, or the like, which would indicate that the listener is distracted and multitasking. Additionally or alternatively, the input data may include a notification and/or media information from other devices associated with the listener, such as devices associated with multimedia playback. To illustrate an example, the listener may be watching video (e.g., a movie or television show) and the server(s) 120 may determine the target speech speed based on a location in the video and/or upcoming content in the video. For example, if the server(s) 120 determine that the video is in a commercial break, the server(s) 120 may increase the target speech speed to playback the voice message prior to the end of the commercial break. Similarly, if the server(s) 120 determine that a current location in the video corresponds to a quiet scene and a loud scene or action or something interesting is coming up, the server(s) 120 may increase the target speech speed. Thus, the server(s) 120 may receive information from additional devices that may influence the target speech speed.

In some examples, the server(s) 120 may determine the target speech speed based on analyzing the input audio data (e.g., message speech data). For example, the server(s) 120 may detect a background noise level and/or signal to noise ratio (SNR) and may determine the target speech speed accordingly. Thus, portions of the input audio data corresponding to a low background noise level and/or high SNR may have an increased target speech speed relative to portions of the input audio data corresponding to a high background noise level and/or low SNR. Similarly, the server(s) 120 may perform automatic speech recognition (ASR) processing on the input audio data and may adjust the target speech speed based on an error rate and/or confidence score associated with the ASR. For example, when the error rate increases and/or confidence scores decrease, the server(s) 120 may decrease the target speech speed.

In some examples, the server(s) 120 may analyze the input audio data and detect types of speech, such as a sequence of numbers (e.g., phone number), a date, an address or the like. For example, the server(s) 120 may decrease a target speech speed for a portion of the input audio data corresponding to a phone number in order to provide the listener additional time to write down the phone number. Additionally or alternatively, the server(s) 120 may detect a foreign accent or foreign language and may decrease the target speech speed.

In some examples, the server(s) 120 may determine different target speech speeds and/or speech speed modification factors for different portions of the input audio data. For example, the server(s) 120 may determine a first target speech speed (e.g., 120 wpm) and/or a first speech speed modification factor (e.g., 0.8×) for a first portion of the input audio data and may determine a second target speech speed (e.g., 100 wpm) and/or a second speech speed modification factor (e.g., 0.66×) for a second portion of the input audio data. In this example, the second portion may include important information (e.g., phone numbers or the like) and the server(s) 120 may decrease the second target speech speed to allow the listener to better understand and/or write down the important information. While this example illustrates dividing the input audio data into two portions, the disclosure is not limited thereto and the number of portions may vary without departing from the disclosure.

In some examples, the server(s) 120 may detect multiple people speaking in the input audio data and may separate speech from different individuals. For example, a first person and a second person may be speaking during the input audio data and the server(s) 120 may identify first speech associated with the first person and second speech associated with the second person. Thus, the server(s) 120 may separate the first speech and the second speech and may separately process the first speech and the second speech (e.g., determine a first target speech speed for the first speech and a second target speech speed for the second speech). Additionally or alternatively, the server(s) 120 may divide the first speech and/or the second speech into portions and may determine different target speech speeds for each of the portions, as discussed above. While this example illustrates identifying speech associated with two different people, the disclosure is not limited thereto and the server(s) 120 may identify three or more distinct voices/people without departing from the disclosure. The server(s) 120 may identify and separate the speech based on voice recognition, beamforming (e.g., separating the input audio data into multiple separate beams, with each beam corresponding to a different location relative to the microphone(s) 112), input data indicating an identity of each user associated with the input audio data, facial recognition (e.g., for input audio data corresponding to video data) and/or the like.

In some examples, the server(s) 120 may determine the target speech speed in order to synchronize speech with other audio data. For example, the server(s) 120 may synchronize the speech to match a tempo of a song (e.g., similar to auto-tuning pitch, this would auto-synchronize tempo or cadence). Additionally or alternatively, the server(s) 120 may synchronize a timing of the first speech and the second speech. For example, the first speech and the second speech may correspond to a shared message and/or song (e.g., singing "Happy Birthday") and the server(s) 120 may determine the target speech speed for different portions of the first speech and the second speech in order to align individual words and/or pacing between the first speech and the second speech. The number of individuals As used herein, voice normalization refers to performing signal processing to modify speech. For example, portions or an entirety of speech can be modified to change a speech speed, a volume level or the like to improve playback of the speech. In some examples, different portions of the speech may be modified to have different speech speeds, volume levels or the like without departing from the disclosure. While voice normalization may imply modifying the speech to a certain "normal" range (e.g., universal speech speed or the like, such as speeding up slow speech or slowing down fast speech), the disclosure is not limited thereto. Instead, for ease of explanation, voice normalization may refer to any signal processing used to change a speech speed. Thus, slow speech may be slowed down further, or fast speech sped up, without departing from the disclosure. To illustrate an example, audio data may correspond to speech having a slow speech speed, and a portion of the speech may include a phone number. While the speech is already associated with the slow speech speed, the system 100 may further slow the portion of the speech to provide additional time for a user to write down the phone number.

For ease of illustration, FIG. 1 and other drawings illustrate the server(s) 120 performing voice normalization and/or adjusting a speed of human speech playback. However, the disclosure is not limited thereto and a local device (e.g., second device 110*b*) may perform the voice normalization and/or adjusting a speech speed without departing from the disclosure. Additionally or alternatively, the server(s) 120 and the second device 110*b* may perform different and/or overlapping steps associated with the voice normalization and/or adjusting a speech speed. For example, the server(s) 120 may preprocess the input audio data to determine estimated target speech speeds corresponding to the input audio data and the second device 110*b* may adjust the estimated target speech speeds during playback of the output audio data. Thus, the second device 110*b* may determine target speech speeds and/or may send commands to the server(s) 120 instructing the server(s) 120 to adjust the target speech speeds.

As discussed above, the server(s) 120 may perform voice normalization and/or adjust a speed of human speech playback associated with a one way exchange (e.g., voice message) or a two-way exchange (e.g., real-time communication session, such as VoIP telephone conversation or video conversation) without departing from the disclosure. Thus, any reference to performing voice normalization and/or adjusting a speech speed on a voice message and/or corresponding steps may also apply to real-time communication session without departing from the disclosure. For example, the server(s) 120 may periodically determine an original speech speed associated with a person speaking during the communication session and determine a speech speed modification factor that modifies the original speech speed to a target speech speed. Thus, during the communication session, the server(s) 120 may apply a current speech speed modification factor to audio data associated with the person speaking. Thus, the speech speed modification factor may vary over time, depending on the original speech speed of the person speaking. In some examples, the server(s) 120 may determine individual speech speed modification factors for each unique voice (e.g., unique identity) detected in the input audio data. For example, first speech associated with a first person may be adjusted using a first speech speed modification factor while second speech associated with a second person may be adjusted using a second speech speed modification factor. However, the disclosure is not limited thereto and the server(s) 120 may apply a single speech speed modification factor for multiple users without departing from the disclosure.

FIG. 1 illustrates a system configured to adjust a speed of human speech playback according to embodiments of the present disclosure. Although the figures and discussion illustrate certain operational steps of the system in a particular order, the steps described may be performed in a different order (as well as certain steps removed or added) without departing from the intent of the disclosure. As shown in FIG. 1, the system may include one or more devices (e.g., PSTN telephone 20, VoIP device 30, first device 110*a*, and/or second device 110*b*) local to a user along with one or more servers 120 connected across one or more networks 10. The server(s) 120 (which may be one or more different physical devices) may be capable of performing speech processing (e.g., ASR and NLU) as well as non-speech processing operations as described herein. A single server 120 may perform all speech processing or multiple servers 120 may combine to perform all speech processing.

Figure 2:
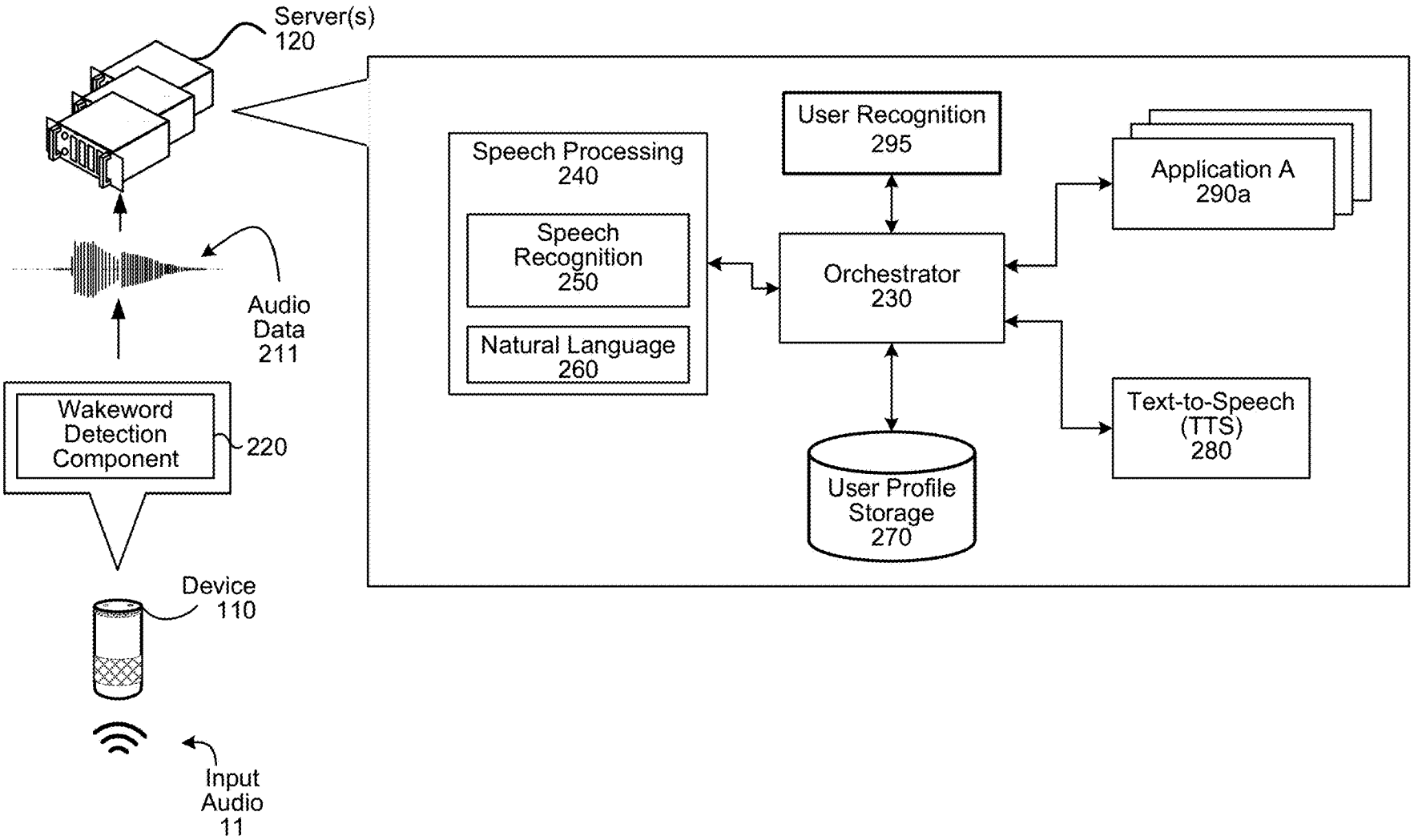
FIG. 2 is a diagram of components of a system according to embodiments of the present disclosure.

As shown in FIG. 2, a device 110 may receive audio 11 including a spoken utterance of a user via microphone(s) 112 (or array of microphones) of the device 110. The device 110 generates audio data 211 corresponding to the audio 11, and sends the audio data 211 to the server(s) 120 for processing. Additionally or alternatively, the device 110 may receive text input by the user via either a physical keyboard or virtual keyboard presented on a touch sensitive display of the device 110. The device 110 generates input text data corresponding to the text, and sends the input text data to the server(s) 120 for processing.

The server(s) 120 receives input data from the device 110. If the input data is the audio data 211, the server(s) 120 performs speech recognition processing (e.g., ASR) on the audio data 211 to generate input text data. The server(s) 120 performs natural language processing (e.g., NLU) on the input text data (either received directly from the device 110 or generated from the audio data 211) to determine a user command. A user command may correspond to a user request for the system to output content to the user. The requested content to be output may correspond to music, video, search results, weather information, etc.

The server(s) 120 determines output content responsive to the user command. The output content may be received from a first party (1P) source (e.g., one controlled or managed by the server(s) 120) or a third party (3P) source (e.g., one managed by an application server(s) (not illustrated) in communication with the server(s) 120 but not controlled or managed by the server(s) 120). The server(s) 120 sends to a device 110 output data including the output content responsive to the user command. The device 110 may emit the output data as audio and/or present the output data on a display.

The system may operate using various components as illustrated in and described with respect to FIG. 2. The various components illustrated in FIG. 2 may be located on a same or different physical device. Communication between various components illustrated in FIG. 2 may occur directly or across a network(s) 10.

An audio capture component, such as a microphone or array of microphones of a device 110, captures the input audio 11 corresponding to a spoken utterance. The device 110, using a wakeword detection component 220, processes audio data corresponding to the input audio 11 to determine if a keyword (e.g., a wakeword) is detected in the audio data. Following detection of a wakeword, the device 110 sends audio data 211, corresponding to the utterance, to a server(s) 120 for processing.

Upon receipt by the server(s) 120, the audio data 211 may be sent to an orchestrator component 230. The orchestrator component 230 may include memory and logic that enable the orchestrator component 230 to transmit various pieces and forms of data to various components of the system.

The orchestrator component 230 sends the audio data 211 to a speech processing component 240. A speech recognition component 250 of the speech processing component 240 transcribes the audio data 211 into text data representing words of speech contained in the audio data 211. The speech recognition component 250 interprets the spoken utterance based on a similarity between the spoken utterance and pre-established language models. For example, the speech recognition component 250 may compare the audio data 211 with models for sounds (e.g., subword units or phonemes) and sequences of sounds to identify words that match the sequence of sounds spoken in the utterance of the audio data 211.

Results of speech recognition processing (i.e., text data representing speech) are processed by a natural language component 260 of the speech processing component 240. The natural language component 260 attempts to make a semantic interpretation of the text data. That is, the natural language component 260 determines the meaning behind the text data based on the individual words in the text data and then implements that meaning. The natural language component 260 interprets a text string to derive an intent or a desired action from the user as well as the pertinent pieces of information in the text data that allow a device (e.g., the device 110, the server(s) 120, the application server(s), etc.) to complete that action. For example, if a spoken utterance is processed using the speech recognition component 250, which outputs the text data "call mom", the natural language component 260 may determine the user intended to activate a telephone in his/her device and to initiate a call with a contact matching the entity "mom."

The natural language component 260 may be configured to determine a "domain" of the utterance so as to determine and narrow down which services offered by an endpoint device (e.g., the server(s) 120 or the device 110) may be relevant. For example, an endpoint device may offer services relating to interactions with a telephone service, a contact list service, a calendar/scheduling service, a music player service, etc. Words in a single textual interpretation may implicate more than one service, and some services may be functionally linked (e.g., both a telephone service and a calendar service may utilize data from a contact list).

The natural language component 260 may include a recognizer that includes a named entity resolution (NER) component configured to parse and tag to annotate text as part of natural language processing. For example, for the text "call mom," "call" may be tagged as a command to execute a phone call and "mom" may be tagged as a specific entity and target of the command. Moreover, the telephone number for the entity corresponding to "mom" stored in a contact list may be included in the NLU results. Further, the natural language component 260 may be used to provide answer data in response to queries, for example using a natural language knowledge base.

In natural language processing, a domain may represent a discrete set of activities having a common theme, such as "shopping," "music," "calendaring," "communications," etc. As such, each domain may be associated with a particular recognizer, language model and/or grammar database, a particular set of intents/actions, and a particular personalized lexicon. Each gazetteer may include domain-indexed lexical information associated with a particular user and/or device. A user's music-domain lexical information (e.g., a gazetteer associated with the user for a music domain) might correspond to album titles, artist names, and song names, for example, whereas a user's contact-list lexical information (e.g., a gazetteer associated with the user for a contact domain) might include the names of contacts. Since every user's music collection and contact list is presumably different, this personalized information improves entity resolution. A lexicon may represent what particular data for a domain is associated with a particular user. The form of the lexicon for a particular domain may be a data structure, such as a gazetteer. A gazetteer may be represented as a vector with many bit values, where each bit indicates whether a data point associated with the bit is associated with a particular user. For example, a music gazetteer may include one or more long vectors, each representing a particular group of musical items (such as albums, songs, artists, etc.) where the vector includes positive bit values for musical items that belong in the user's approved music list. Thus, for a song gazetteer, each bit may be associated with a particular song, and for a particular user's song gazetteer the bit value may be 1 if the song is in the particular user's music list. Other data structure forms for gazetteers or other lexicons are also possible.

As noted above, in traditional natural language processing, text data may be processed applying the rules, models, and information applicable to each identified domain. For example, if text represented in text data potentially implicates both communications and music, the text data may, substantially in parallel, be natural language processed using the grammar models and lexical information for communications, and natural language processed using the grammar models and lexical information for music. The responses based on the text data produced by each set of models is scored, with the overall highest ranked result from all applied domains being ordinarily selected to be the correct result.

A downstream process called named entity resolution actually links a text portion to an actual specific entity known to the system. To perform named entity resolution, the system may utilize gazetteer information stored in an entity library storage. The gazetteer information may be used for entity resolution, for example matching speech recognition results with different entities (e.g., song titles, contact names, etc.). Gazetteers may be linked to users (e.g., a particular gazetteer may be associated with a specific user's music collection), may be linked to certain domains (e.g., shopping, music, communications), or may be organized in a variety of other ways. The NER component may also determine whether a word refers to an entity that is not explicitly mentioned in the text data, for example "him," "her," "it" or other anaphora, exophora or the like.

A recognizer of the natural language component 260 may also include an intent classification (IC) component that processes text data to determine an intent(s), where the intent(s) corresponds to the action to be performed that is responsive to the user command represented in the text data. Each recognizer is associated with a database of words linked to intents. For example, a music intent database may link words and phrases such as "quiet," "volume off," and "mute" to a "mute" intent. The IC component identifies potential intents by comparing words in the text data to the words and phrases in the intents database. Traditionally, the IC component determines using a set of rules or templates that are processed against the incoming text data to identify a matching intent.

In order to generate a particular interpreted response, the NER component applies the grammar models and lexical information associated with the respective recognizer to recognize a mention of one or more entities in the text represented in the text data. In this manner the NER component identifies "slots" (i.e., particular words in text data) that may be needed for later command processing. Depending on the complexity of the NER component, it may also label each slot with a type (e.g., noun, place, city, artist name, song name, or the like). Each grammar model includes the names of entities (i.e., nouns) commonly found in speech about the particular domain (i.e., generic terms), whereas the lexical information from the gazetteer is personalized to the user(s) and/or the device. For instance, a grammar model associated with the shopping domain may include a database of words commonly used when people discuss shopping.

The intents identified by the IC component are linked to domain-specific grammar frameworks with "slots" or "fields" to be filled. Each slot/field corresponds to a portion of the text data that the system believes corresponds to an entity. For example, if "play music" is an identified intent, a grammar framework(s) may correspond to sentence structures such as "Play {Artist Name}," "Play {Album Name}," "Play {Song name}," "Play {Song name} by {Artist Name}," etc. However, to make resolution more flexible, these frameworks would ordinarily not be structured as sentences, but rather based on associating slots with grammatical tags.

For example, the NER component may parse the text data to identify words as subject, object, verb, preposition, etc., based on grammar rules and/or models, prior to recognizing named entities. The identified verb may be used by the IC component to identify intent, which is then used by the NER component to identify frameworks. A framework for an intent of "play" may specify a list of slots/fields applicable to play the identified "object" and any object modifier (e.g., a prepositional phrase), such as {Artist Name}, {Album Name}, {Song name}, etc. The NER component then searches the corresponding fields in the domain-specific and personalized lexicon(s), attempting to match words and phrases in the text data tagged as a grammatical object or object modifier with those identified in the database(s).

To illustrate an example, a command of "book me a plane ticket from Boston to Seattle for July 5" may be associated with a <BookPlaneTicket> intent. The <BookPlaneTicket> intent may be associated with a framework including various slots including, for example, <DepartureDate>, <DepartureLocation>, <ArrivalDate>, and <DestinationLocation>. In the above example, the server(s) 120, namely the natural language component 260, may populate the framework as follows: <DepartureDate: July 5>, <DepartureLocation: Boston>, <ArrivalDate: July 5>, and <DestinationLocation: Seattle>.

This process includes semantic tagging, which is the labeling of a word or combination of words according to their type/semantic meaning. Parsing may be performed using heuristic grammar rules, or the NER component may be constructed using techniques such as HMMs, maximum entropy models, log linear models, conditional random fields (CRF), and the like.

For instance, a query of "play mother's little helper by the rolling stones" might be parsed and tagged as {Verb}: "Play," {Object}: "mother's little helper," {Object Preposition}: "by," and {Object Modifier}: "the rolling stones." At this point in the process, "Play" is identified as a verb based on a word database associated with the music domain, which the IC component will determine corresponds to the "play music" intent. At this stage, no determination has been made as to the meaning of "mother's little helper" and "the rolling stones," but based on grammar rules and models, it is determined that the text of these phrases relate to the grammatical object (i.e., entity) of the text data.

The frameworks linked to the intent are then used to determine what database fields should be searched to determine the meaning of these phrases, such as searching a user's gazette for similarity with the framework slots. So a framework for "play music intent" might indicate to attempt to resolve the identified object based on {Artist Name}, {Album Name}, and {Song name}, and another framework for the same intent might indicate to attempt to resolve the object modifier based on {Artist Name}, and resolve the object based on {Album Name} and {Song Name} linked to the identified {Artist Name}. If the search of the gazetteer does not resolve the slot/field using gazetteer information, the NER component may search a database of generic words associated with the domain. For example, if the text data corresponds to "play songs by the rolling stones," after failing to determine an album name or song name called "songs" by "the rolling stones," the NER component may search the domain vocabulary for the word "songs." In the alternative, generic words may be checked before the gazetteer information, or both may be tried, potentially producing two different results.

The results of natural language processing may be tagged to attribute meaning to the text data. So, for instance, "play mother's little helper by the rolling stones" might produce a result of: {domain} Music, {intent} Play Music, {artist name} "rolling stones," {media type} SONG, and {song title} "mother's little helper." As another example, "play songs by the rolling stones" might produce: {domain} Music, {intent} Play Music, {artist name} "rolling stones," and {media type} SONG.

The results of natural language processing may be sent to an application 290, which may be located on a same or separate server 120 as part of system. The system may include more than one application 290, and the destination application 290 may be determined based on the natural language processing results. For example, if the natural language processing results include a command to play music, the destination application 290 may be a music playing application, such as one located on the device 110 or in a music playing appliance, configured to execute a music playing command. If the natural language processing results include a search request (e.g., requesting the return of search results), the application 290 selected may include a search engine application, such as one located on a search server, configured to execute a search command and determine search results, which may include output text data to be processed by a text-to-speech engine and output from a device as synthesized speech.

The server(s) 120 may include a user recognition component 295. The user recognition component 295 may take as input the audio data 211 as well as the text data output by the speech recognition component 250. The user recognition component 295 may receive the text data from the speech recognition component 250 either directly or indirectly via the orchestrator component 230. Alternatively, the user recognition component 295 may be implemented as part of the speech recognition component 250. The user recognition component 295 determines respective scores indicating whether the utterance in the audio data 211 was spoken by particular users. The user recognition component 295 also determines an overall confidence regarding the accuracy of user recognition operations. User recognition may involve comparing speech characteristics in the audio data 211 to stored speech characteristics of users. User recognition may also involve comparing biometric data (e.g., fingerprint data, iris data, etc.) received by the user recognition component 295 to stored biometric data of users. User recognition may further involve comparing image data including a representation of at least a feature of a user with stored image data including representations of features of users. It should be appreciated that other kinds of user recognition processes, including those known in the art, may be used. Output of the user recognition component 295 may be used to inform natural language processing as well as processing performed by 1P and 3P applications 290.

The server(s) 120 may additionally include user profile storage 270. The user profile storage 270 includes data regarding user accounts. As illustrated, the user profile storage 270 is implemented as part of the server(s) 120. However, it should be appreciated that the user profile storage 270 may be located proximate to the server(s) 120, or may otherwise be in communication with the server(s) 120, for example over the network(s) 10. The user profile storage 270 may include a variety of information related to individual users, accounts, etc. that interact with the system.

FIG. 2 illustrates various 1P applications 290 of the system. However, it should be appreciated that the data sent to the 1P applications 290 may also be sent to 3P application servers executing 3P applications.

In some examples, an application 290 may correspond to a communications application configured to control communications (e.g., a communication session, including audio data and/or image data), voice messages (e.g., playback one or more voice messages stored in voicemail or the like), or the like. The communications application may be configured to perform normalization (e.g., power normalization, volume normalization or the like) and/or adjust a speech speed of audio data associated with the communication session (e.g., in real-time during the communication session) or the voice messages (e.g., offline, prior to playback of the voice messages, and/or in real-time during playback of the voice messages). For example, the communication application may modify the speech speed of a voice message at a first time and, after the user requests playback of the voice message, may output the modified voice message at a second time. In some examples, the communication application may begin outputting the modified voice message at the second time and may adjust the speech speed and generate a second modified voice message during playback (e.g., in response to a user command). Additionally or alternatively, the communication application may begin outputting the original voice message when the user requests playback of the voice message and may modify the speech speed of the voice message during playback (e.g., in response to a user command).

Application, as used herein, may be considered synonymous with a skill. A "skill" may correspond to a domain and may be software running on a server(s) 120 and akin to an application. That is, a skill may enable a server(s) 120 or application server(s) to execute specific functionality in order to provide data or produce some other output called for by a user. The system may be configured with more than one skill. For example a weather service skill may enable the server(s) 120 to execute a command with respect to a weather service server(s), a car service skill may enable the server(s) 120 to execute a command with respect to a taxi service server(s), an order pizza skill may enable the server(s) 120 to execute a command with respect to a restaurant server(s), etc.

Output of the application/skill 290 may be in the form of text data to be conveyed to a user. As such, the application/skill output text data may be sent to a text-to-speech (TTS) component 280 either directly or indirectly via the orchestrator component 230. The TTS component 280 may synthesize speech corresponding to the received text data. Speech audio data synthesized by the TTS component 280 may be sent to a device 110 for output to a user.

The TTS component 280 may perform speech synthesis using one or more different methods. In one method of synthesis called unit selection, the TTS component 280 matches the text data or a derivative thereof against a database of recorded speech. Matching units are selected and concatenated together to form speech audio data. In another method of synthesis called parametric synthesis, the TTS component 280 varies parameters such as frequency, volume, and noise to create an artificial speech waveform output. Parametric synthesis uses a computerized voice generator, sometimes called a vocoder.

Figure 3A:
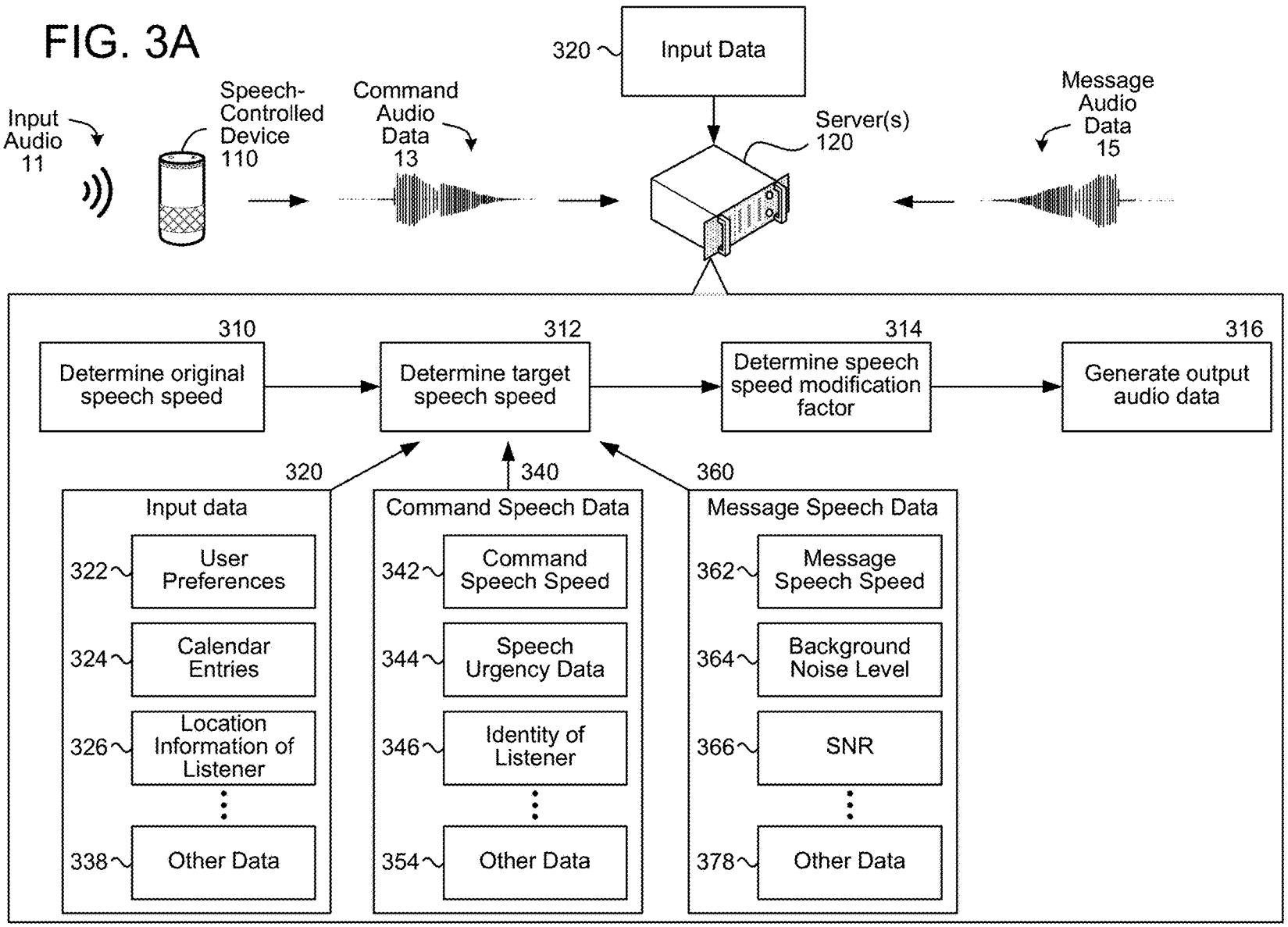
FIGS. 3A-3D illustrate a conceptual diagram of how adjusting a speed of human speech playback is performed along with examples of input data, command speech data and message data used to adjust the speech speed according to examples of the present disclosure.
Figure 3B:
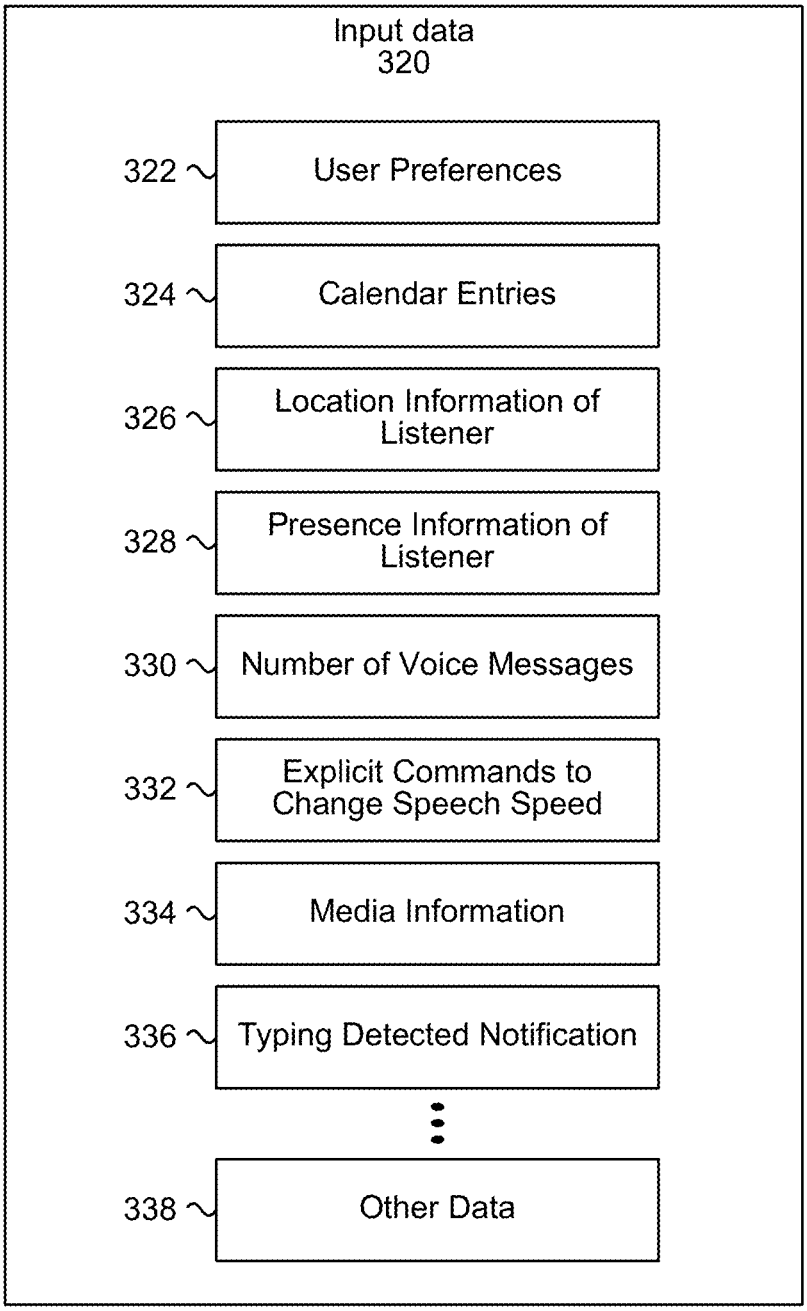

FIG. 3A is a conceptual diagram of how adjusting a speed of human speech playback is performed according to examples of the present disclosure. As illustrated in FIG. 3A, input audio 11 may be captured by a speech-controlled device 110 (e.g., second device 110*b*) as command audio data 13 and the command audio data 13 may be sent to the server(s) 120. The server(s) 120 may process the command audio data 13 and determine that the command audio data 13 corresponds to a command to play voice messages stored on the server(s) 120. The server(s) 120 may identify message audio data 15 corresponding to a voice message and may perform voice normalization and/or adjust a speed of human speech playback on the message audio data 15. To perform voice normalization and/or adjust a speech speed, the server(s) 120 may receive input data 320 from the speech-controlled device 110 and/or additional devices. Additionally or alternatively, the server(s) 120 may analyze the command audio data 13 to generate command speech data 340 and/or analyze the message audio data 15 to generate message speech data 360.

As illustrated in FIG. 3A, in some examples the server(s) 120 may receive a voice command (e.g., command audio data 13) instructing the server(s) 120 to playback the voice message and the server(s) 120 may analyze the command audio data 13 to determine the command and to generate the command speech data 340, which may be used to determine the target speech speed. However, the disclosure is not limited thereto and the server(s) 120 may receive a command that is not associated with command audio data 13 without departing from the disclosure. For example, the second device 110*b* may receive input on a touchscreen display that corresponds to the command and may send the command to the server(s) 120 to instruct the server(s) 120 to begin playback of one or more voice messages. Thus, the server(s) 120 may perform voice normalization and/or adjust a speech speed without receiving the command audio data 13 and/or generating the command speech data 340.

As discussed above, the server(s) 120 may perform voice normalization and/or adjust a speech speed by determining (310) an original speech speed associated with speech represented in the message audio data 15 (e.g., input audio data), determining (312) a target speech speed, determining (314) a speech speed modification factor and generating (316) output audio data based on the message audio data 15 and the speech speed modification factor. The server(s) 120 may determine the target speech speed dynamically for portions of the message audio data 15 based on the input data 320, the command speech data 340 and/or the message speech data 360.

As illustrated in FIGS. 3A-3B, the input data 320 may include a variety of information, such as user preferences 322 (e.g., previous settings associated with the user, such as a preferred target speech speed (e.g., playback speed), target speech speeds associated with different identities associated with the message audio data 15, etc.), calendar entries 324 (e.g., calendar data associated with upcoming or recent meeting information or the like), location information of a listener 326 (e.g., location data indicating current location of the second device 110*b* during playback, such as GPS coordinates or the like), presence information of the listener 328 (e.g., whether human presence is detected by the second device 110*b*), a number of voice messages 330 (e.g., a total number of voice messages), explicit commands to change speech speed 332 (e.g., a command input to a companion device, a previous request of "Alexa, increase speech speed," or the like), media information 334 (e.g., information about content being viewed by the listener, received from the second device 110*b* and/or a companion device associated with the account), typing detected notification 336 (e.g., notification that the listener is typing received from the second device 110*b* or a companion device associated with the account) and/or other data 338 (e.g., any other non-audio data associated with the command to playback the voice message at the time that the command is received and/or during playback).

An example of other data 338 may include identity information associated with a listener. For example, a companion device (e.g., smart phone 110*a*) may be associated with a particular user profile, and if the companion device is in proximity to the second device 110*b* when the second device 110*b* receives input audio data, the system 100 may include an identity associated with the user profile in the input data 320. Alternatively, the companion device may receive the command and generate the input audio data, in which case the companion device may include the identity associated with the companion device in the input data 320. Similarly, the second device 110*b* itself may be associated with an identity and the input data 320 may include the identity associated with the second device 110*b* in the input data 320. Additionally or alternatively, other techniques may be used to identify the identity of the user speaking the command (e.g., the listener). For example, the identity of the listener may be determined using facial recognition or the like, and the server(s) 120 may receive an indication of the identity of the listener as part of the input data 320

Figure 3C:
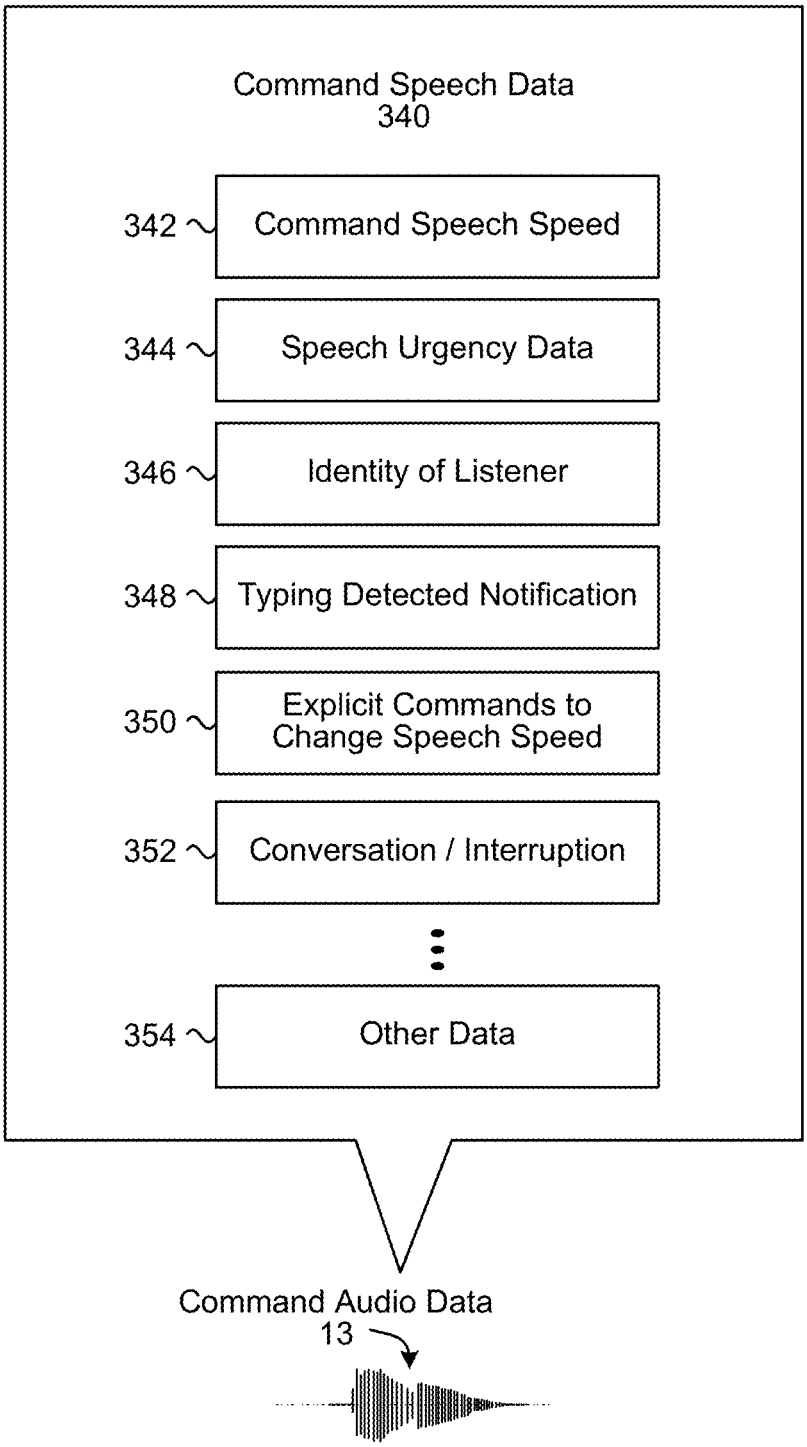

As illustrated in FIG. 3A and FIG. 3C, the server(s) 120 may analyze the command audio data 13 to generate command speech data 340, which may include a variety of information such as a command speech speed 342 (e.g., detected speech speed of speech represented in the command audio data 13), speech urgency data (e.g., determined based on content of the command audio data 13), an identity of the listener 346 (e.g., identity of the user associated with the command to playback voice messages, which may be determined based on voice recognition, facial recognition, data received from a companion device or the like), typing detected notification 348 (e.g., sounds associated with a keyboard and/or typing detected in the command audio data 13), explicit commands to change speech speed 350 (e.g., "Alexa, increase speech speed"), conversation/interruption 352 (e.g., detecting that conversation or other interruption occurs during playback of the voice messages), and/or other data 354. If the identity of the listener is not determined based on the command audio data 13 (e.g., not determined using voice recognition or the like), the identity of the listener may instead be associated with the input data 320. For example, if the identity of the listener is determined using facial recognition or based on a companion device (e.g., smartphone) associated with a user, the server(s) 120 may receive an indication of the identity of the listener as part of the input data 320 without departing from the disclosure.

In some examples, the command audio data 13 corresponds to audio data received that instructs the server(s) 120 to perform playback of the voice messages (e.g., audio data prior to playback). However, the disclosure is not limited thereto and the command audio data may correspond to audio data received during playback of the voice messages.

Thus, the typing detected notification 348, explicit commands to change speech speed 350, and/or the conversation/interruption 352 may correspond to when the voice message is being played back by the second device 110*b* without departing from the disclosure.

As used herein, the input data 320 and the command speech data 340 may be collectively referred to as configuration data. Thus, configuration data corresponds to non-message data used to determine the target speech speed. For example, the configuration data may correspond to information about the listener (e.g., user preferences, calendar entries, location information, identity, or the like that is included in a user profile associated with the listener), contextual information (e.g., a number of voice messages, previous commands, media information, typing detected notification, etc.), the command (e.g., command speech speed, speech urgency data, audio cues included in the command audio data 13, etc.), or the like.

Figure 3D:
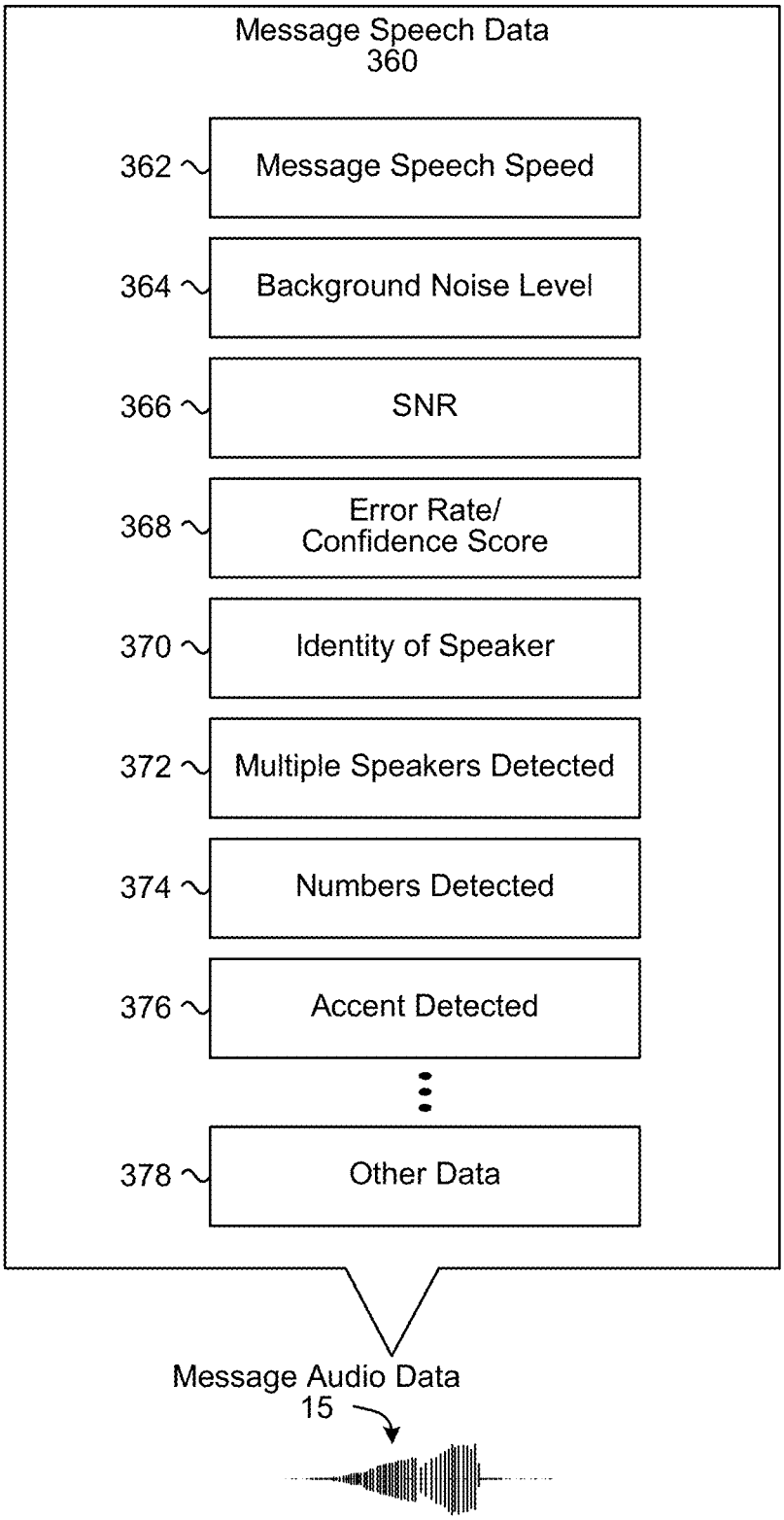

As illustrated in FIG. 3A and FIG. 3D, the server(s) 120 may analyze the message audio data 15 to generate message speech data 360, which may include a variety of information such as a message speech speed 362 (e.g., original speech speed(s) for speech represented in the message audio data 15), a background noise level 364 (e.g., background noise power associated with the message audio data 15), a signal to noise ratio (SNR) 366 associated with the message audio data 15, an error rate/confidence score 368 associated with portions of the message audio data 15 after performing speech recognition or the like, an identity of a speaker 370 (e.g., identity of a user associated with speech represented in the message audio data 15), multiple speakers detected 372 (e.g., an indication that speech is detected from multiple different people), numbers detected 374 (e.g., detected sounds that may correspond to numbers, such as a sequence of numbers corresponding to a phone number), an indication that an accent is detected 376 (e.g., detecting that the speech is associated with a foreign accent is therefore more difficult to understand), and/or other data 378.

An example of information included in other data 378 is an age associated with the speaker. For example, a young child may be more difficult to understand and therefore the server(s) 120 may slow a speech speed to improve performance. In some examples, the age may be included in the identity of the speaker 370, although the disclosure is not limited thereto. The other data 378 may also include additional information that the server(s) 120 determine to be important, such as names, times, dates, phone numbers, addresses or the like. For example, the server(s) 120 may perform automatic speech recognition and/or natural language understanding to identify entities and may determine that the entities are likely to be significant. Thus, the server(s) 120 may analyze content of the voice message, detect portions that are likely to be important and adjust the target speech speed to improve playback of the voice message.

The message speech speed 362 may determine an overall speech speed associated with the voice message, such as an average speech speed over an entirety of the voice message. However, the disclosure is not limited thereto, and the message speech speed 362 may include more complex data such as an average speech speed for different portions of the voice message. For example, the message speech speed 362 may indicate an average speech speed for a fixed duration of time (e.g., 2 seconds, 5 seconds, etc.). Additionally or alternatively, the server(s) 120 may identify portions of the voice message associated with similar speech speeds (e.g., a range of speech speeds) and the message speech speed 362 may indicate the portions and an average speech speed for each portion. For example, the voice message may start at a first speech speed for 5 seconds and then slow to a second speech speed for 15 seconds. Thus, the message speech speed 362 included in the message speech data 360 may indicate that the first portion corresponds to the first 5 seconds (e.g., begin time=0 s, end time=5 s) and has the first speech speed (e.g., speech speed=150 words per minute) and that the second portion corresponds to the next 15 seconds (e.g., begin time=5 s, end time=20 s) and has the second speech speed (e.g., speech speed=100 words per minute). Thus, the original speech speed may vary over time and the server(s) 120 may track variations in the original speech speed and modify a speech speed modification factor to match the target speech speed.

While not illustrated in FIG. 3A and/or FIG. 3D, the server(s) 120 may optionally perform voice activity detection (VAD) to detect voice activity (e.g., speech) in the command audio data 13 and/or the message audio data 15 without departing from the disclosure. The server(s) 120 may perform VAD using techniques known to one of skill in the art and performing the VAD may reduce a processing load on the server(s) 120 as the server(s) 120 may only perform voice normalization and/or adjust a speech speed for portions of the command audio data 13 and/or the message audio data 15 that correspond to speech. VAD techniques may determine whether speech is present in a particular section of audio data based on various quantitative aspects of the audio data, such as the spectral slope between one or more frames of the audio data; the energy levels of the audio data in one or more spectral bands; the signal-to-noise ratios of the audio data in one or more spectral bands; or other quantitative aspects. In other embodiments, the server(s) 120 may implement a limited classifier configured to distinguish speech from background noise. The classifier may be implemented by techniques such as linear classifiers, support vector machines, and decision trees. In still other embodiments, Hidden Markov Model (HMM) or Gaussian Mixture Model (GMM) techniques may be applied to compare the audio data to one or more acoustic models. The acoustic models may include models corresponding to speech, noise (such as environmental noise or background noise), or silence. Still other techniques may be used to determine whether speech is present in the audio data.

Figure 4A:
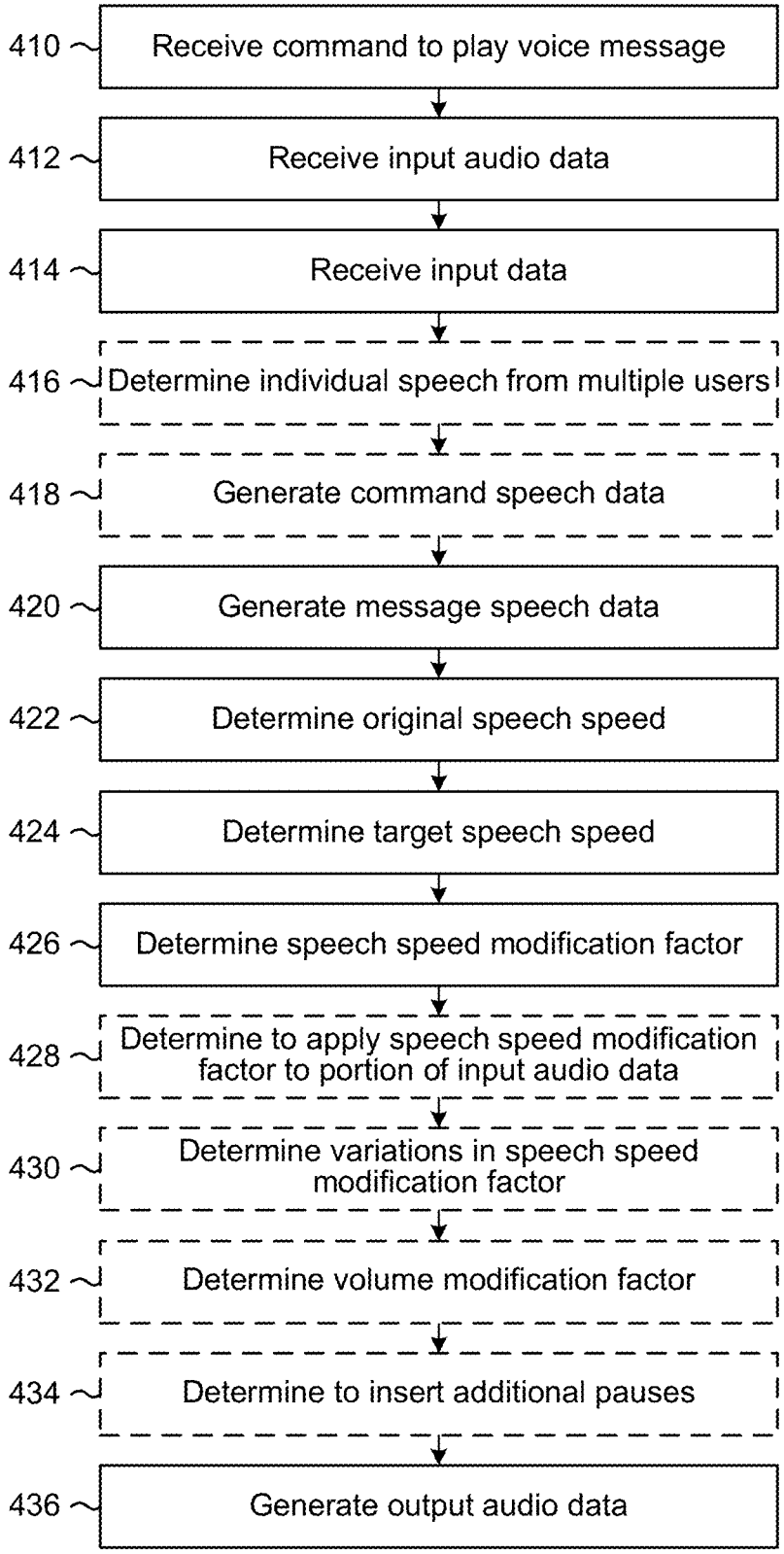
FIGS. 4A-4B are flowcharts conceptually illustrating example methods for adjusting a speed of human speech playback according to examples of the present disclosure.
Figure 4B:
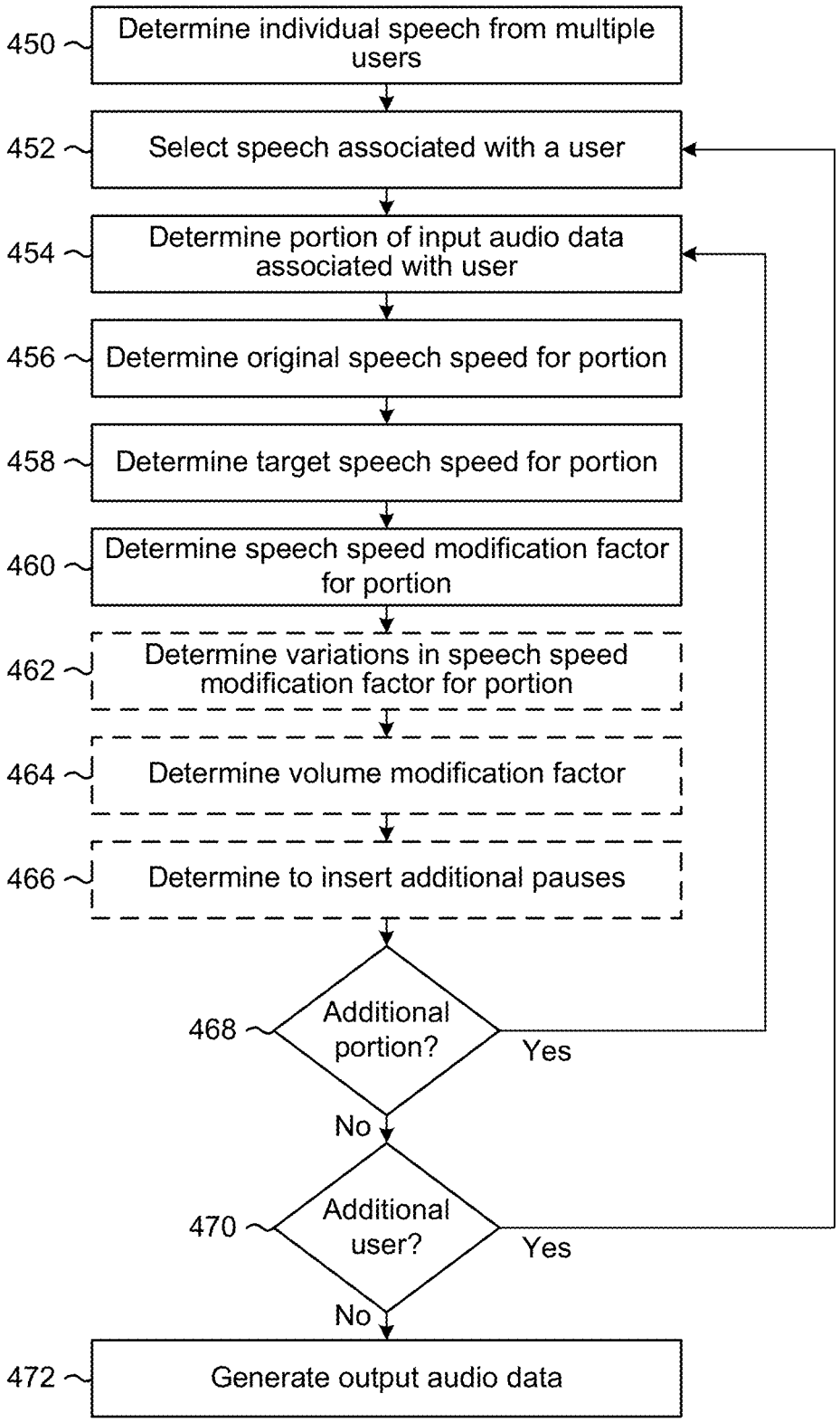

FIGS. 4A-4B are flowcharts conceptually illustrating example methods for adjusting a speed of human speech playback according to examples of the present disclosure. As illustrated in FIG. 4A, the server(s) 120 may receive (410) a command to play a voice message, may receive (412) input audio data and may receive (414) input data. As discussed above, the input data may correspond to non-audio data associated with the account, the device (e.g., second device 110*b*) and/or the user without departing from the disclosure.

The server(s) 120 may optionally determine (416) individual speech from multiple users (e.g., separate the input audio data into different segments of speech, with each segment of speech corresponding to a unique user/speaker). The server(s) 120 may also optionally generate (418) command speech data associated with command audio data 13, such as when the command is a voice command. However, the disclosure is not limited thereto and even when the command to play the voice message is not a voice command, the server(s) 120 may receive command audio data 13 from the second device 110*b* (e.g., during playback of the voice message) and may generate the command speech data based on the command audio data 13 without departing from the disclosure.

The server(s) 120 may generate (420) message speech data associated with the input audio data, and, either as part of generating the message speech data or as a separate step, may determine (422) an original speech speed associated with the input audio data. In some examples, the server(s) 120 may determine different original speech speeds associated with different portions of the input audio data, such as when the user speeds up or slows down while leaving the voice message. The server(s) 120 may determine (424) a target speech speed, as discussed in greater detail above with regard to FIG. 1, and may determine (426) a speech speed modification factor based on the target speech speed and the original speech speed. For example, the server(s) 120 may divide the target speech speed by the original speech speed to determine the speech speed modification factor.

The server(s) 120 may optionally determine (428) to apply the speech speed modification factor to a portion of the input audio data. For example, the server(s) 120 may apply different speech speed modification factors to different portions of the input audio data without departing from the disclosure. Additionally or alternatively, the server(s) 120 may optionally determine (430) variations in the speech speed modification factor to reduce a distortion of the output audio data. For example, instead of abruptly changing from a first speech speed to a second speech speed, the server(s) 120 may incrementally transition from the first speech speed to the second speech speed using a maximum transition value to avoid abrupt changes in the output audio data that could result in distortion. In some examples, the server(s) 120 may determine a number of increments by dividing a change in speech speed (e.g., difference between the first speech speed factor and the second speech speed factor) by the maximum transition value, with the number of increments indicating a number of discrete speech speed modification factors over which to transition from a first speech speed factor to a second speech speed factor using the maximum transition value.

The server(s) 120 may optionally determine (432) a volume modification factor and/or determine (434) to insert additional pauses. The volume modification factor may increase a volume of the output audio data and the server(s) 120 may determine the volume modification factor based on the target speech speed associated with the output audio data. For example, the server(s) 120 may identify that a portion of the input audio data corresponds to a decreased target speech speed and may increase the volume modification factor for the portion of the input audio data, as discussed in greater detail below with regard to FIGS. 8A-8B. Thus, the server(s) 120 may simultaneously slow down the target speech speed while increasing a volume level to further improve playback of the voice message and enable the listener to understand speech represented in the output audio data.

The server(s) 120 may generate (436) output audio data based on the input audio data and the speech speed modification factor(s) determined in step 426. In some examples, the server(s) 120 may determine a single speech speed modification factor associated with the input audio data and may generate the output audio data by applying the speech speed modification factor to an entirety of the input audio data. However, the disclosure is not limited thereto and the server(s) 120 may instead determine a plurality of speech speed modification factors and may generate the output audio data by applying the plurality of speech speed modification factors to corresponding portions of the input audio data without departing from the disclosure.

FIG. 4B is similar to FIG. 4A but is intended to illustrate how the server(s) 120 dynamically adjust target speech speeds and/or speech speed modification factors for different portions of the input audio data.

As illustrated in FIG. 4B, the server(s) 120 may determine (450) individual speech from multiple users (e.g., separate the input audio data into different segments of speech, with each segment of speech corresponding to a unique user/speaker). The server(s) 120 may select (452) speech associated with a user (e.g., first speech associated with a first user) and may determine (454) a portion of the input audio data associated with the user. The server(s) 120 may determine (456) an original speech speed for the selected portion, may determine (458) a target speech speed for the selected portion, and may determine (460) a speech speed modification factor for the selected portion. For example, the server(s) 120 may divide the target speech speed by the original speech speed to determine the speech speed modification factor.

The server(s) 120 may optionally determine (462) variations in the speech speed modification factor for the selected portion based on the maximum transition value (e.g., to reduce distortion in the output audio data as discussed above with regard to step 430), may optionally determine (464) a volume modification factor for the selected portion (e.g., to improve playback of the voice message, as discussed above with regard to step 432) and may optionally determine (466) to insert additional pauses in the selected portion.

The server(s) 120 may determine (468) if an additional portion of the input audio data is present, and if so, may loop to step 454 and repeat steps 454-466 for the additional portion. If an additional portion of the input audio data is not present, the server(s) 120 may determine (470) if an additional user is present and, if so, may loop to step 452 and repeat steps 452-468 for speech associated with the additional user. If an additional user is not determined to be represented in the input audio data, the server(s) 120 may generate (472) output audio data based on the input audio data, the speech speed modification factor(s) determined in steps 460 and 462, the volume modification factor(s) determined in step 464, and/or the additional pauses inserted in step 466.

While many examples described above refer to adjusting a speech speed of a voice message, the disclosure is not limited thereto. Instead, the server(s) 120 may adjust a speech speed in real-time during a communication session without departing from the disclosure. For example, the server(s) 120 may periodically determine an original speech speed associated with a person speaking during the communication session and determine a speech speed modification factor that modifies the original speech speed to a target speech speed. Thus, during the communication session, the server(s) 120 may apply a current speech speed modification factor to audio data associated with the person speaking. Thus, the speech speed modification factor may vary over time, depending on the original speech speed of the person speaking. In some examples, the server(s) 120 may determine individual speech speed modification factors for each unique voice (e.g., unique identity) detected in the input audio data. For example, first speech associated with a first person may be adjusted using a first speech speed modification factor while second speech associated with a second person may be adjusted using a second speech speed modification factor. However, the disclosure is not limited thereto and the server(s) 120 may apply a single speech speed modification factor for multiple users without departing from the disclosure.

Figure 5:
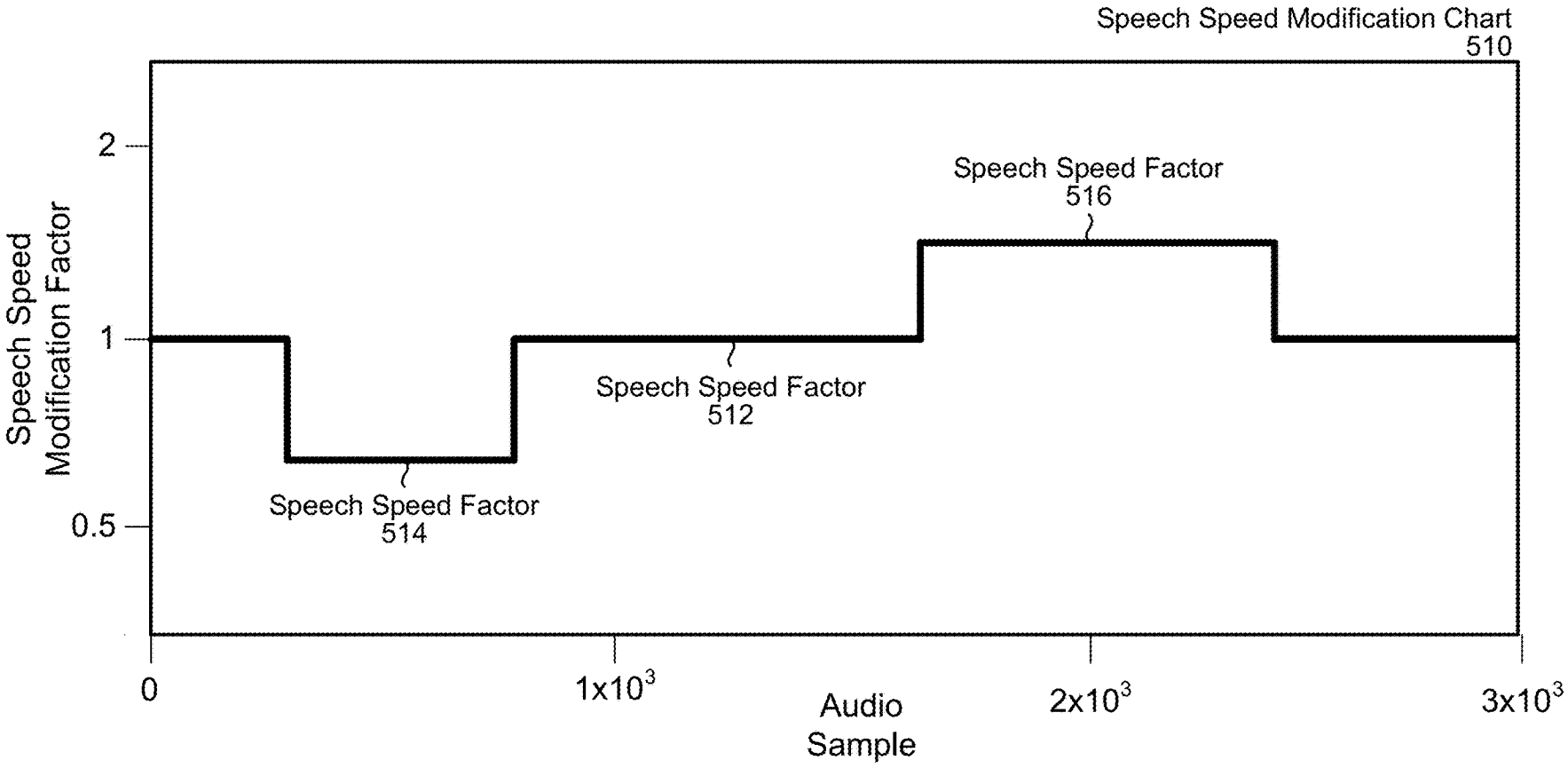
FIG. 5 illustrates an example of applying different speech speed modification variables to different portions of input audio data according to examples of the present disclosure.

FIG. 5 illustrates an example of applying different speech speed modification factors to different portions of input audio data according to examples of the present disclosure. As shown in FIG. 5, a speech speed modification chart 510 illustrates a variety of speech speed modification factors (which may be referred to as speech speed factors without departing from the disclosure), such as a first speech speed factor 512, a second speech speed factor 514 and a third speech speed factor 516. The first speech speed factor 512 (e.g., 1×) may correspond to a neutral speech speed factor that does not modify a speech speed of the input audio data, and the first speech speed factor 512 may be used anywhere that the input audio data does not need to be modified. For example, if the original speech speed is similar to the target speech speed, the server(s) 120 may use the first speech speed factor 512 throughout the input audio data.

In contrast, the second speech speed factor 514 corresponds to a lower speech speed factor (e.g., 0.66×), which is used to intentionally slow down a portion of the input audio data. For example, the server(s) 120 may detect that the original speech speed is too fast relative to the target speech speed for a first portion of the input audio data and may use the second speech speed factor 514 to decrease a speech speed associated with the first portion. Similarly, the third speech speed factor 516 corresponds to a higher speech speed factor (e.g., 0.7×), which is used to intentionally speed up a portion of the input audio data. For example, the server(s) 120 may detect that the original speech speed is too slow relative to the target speech speed for a second portion of the input audio data and may use the third speech speed factor 516 to increase a speech speed associated with the second portion.

As illustrated in FIG. 5, the server(s) 120 may vary the speech speed modification factor throughout the input audio data, allowing the server(s) 120 to dynamically determine an appropriate speech speed modification factor based on characteristics associated with the input audio data. For example, portions of the input audio data corresponding to information which a listener may need to write down or record (e.g., phone number, names, etc.) may be slowed down while other portions of the input audio data are left as is or sped up.

Figure 6:
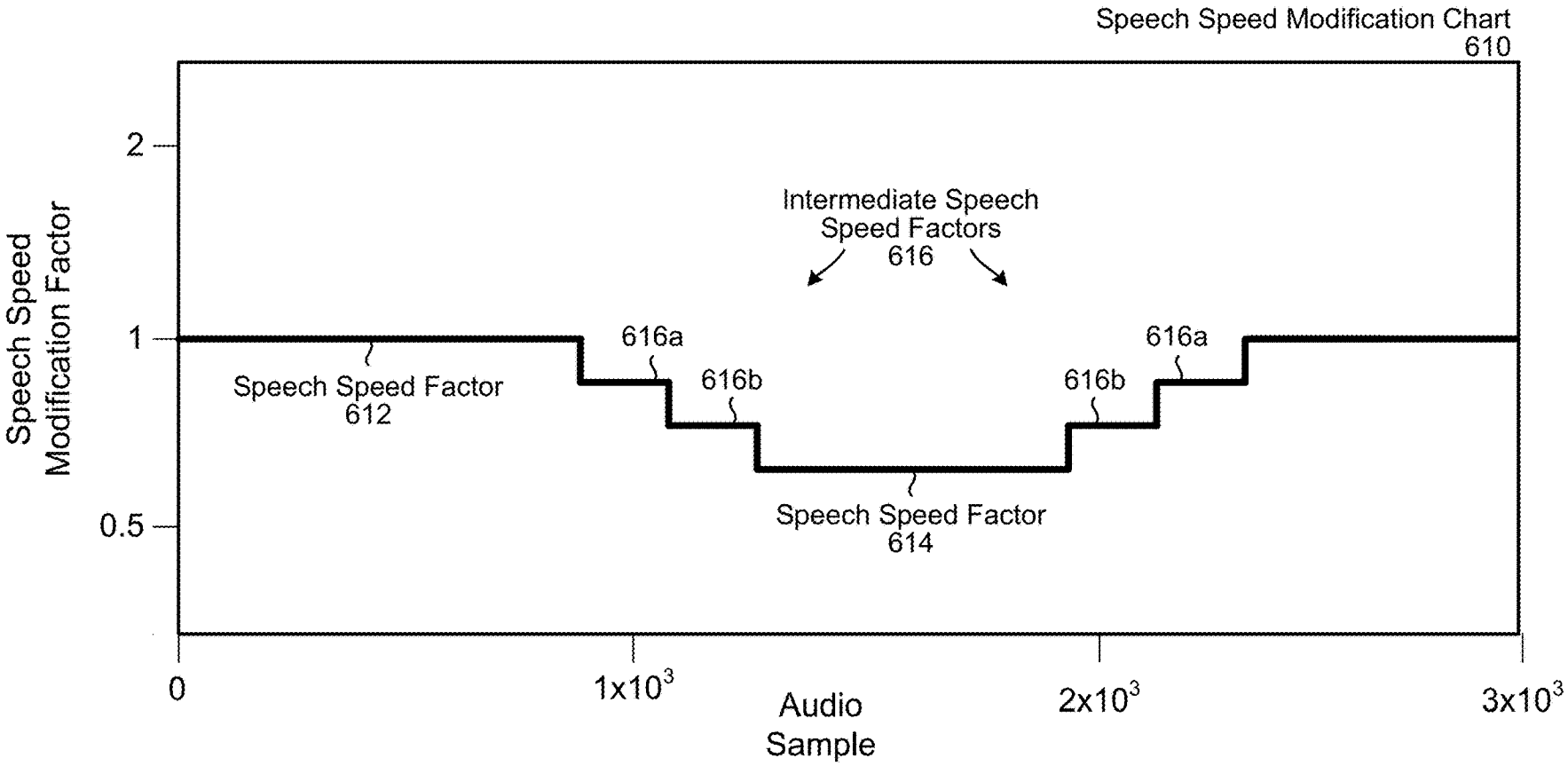
FIG. 6 illustrates an example of incrementally changing speech speed modification variables to avoid distortion according to examples of the present disclosure.

FIG. 6 illustrates an example of incrementally changing speech speed modification factors to avoid distortion according to examples of the present disclosure. While FIG. 5 illustrates the server(s) 120 varying speech speed modification factors for different portions of the input audio data, FIG. 6 is directed instead to the server(s) 120 incrementally transitioning to a speech speed modification factor to reduce distortion in the output audio data. For example, instead of abruptly transitioning from a first speech speed modification factor to a second speech speed modification factor, the server(s) 120 may transition incrementally over time to avoid abrupt changes in the output audio data that could result in distortion.

As shown in FIG. 6, a speech speed modification chart 610 illustrates changing from a first speech speed factor 612 to a second speech speed factor 614. To avoid an abrupt change in speech speed, the server(s) 120 may increment the speech speed modification factor slowly over time. For example, the server(s) 120 may determine a number of increments by dividing a change in speech speed (e.g., difference between the first speech speed factor 612 and the second speech speed factor 614) by a maximum transition value, with the number of increments indicating how many speech speed modification factors with which to transition from the first speech speed factor 612 to the second speech speed factor 614 using the maximum transition value. The server(s) 120 may apply each speech speed modification factor for a minimum number of audio samples (e.g., minimum duration of time) before transitioning to the next speech speed modification factor.

To illustrate an example, if the maximum transition value is 0.1× and the difference between the first speech speed factor 612 (e.g., 1×) and the second speech speed factor 614 (e.g., 0.7×) is 0.3×, the server(s) 120 may transition from the first speech speed factor 612 to the second speech speed factor 614 using a total of three increments of 0.1× each. Thus, the server(s) 120 may transition from the first speech speed factor 612 (e.g., 1×) to a first intermediate speech speed factor 616*a* (e.g., 0.9×), from the first intermediate speech speed factor 616*a* to a second intermediate speech speed factor 616*b* (e.g., 0.8×), and from the second intermediate speech speed factor 616*b* to the second speech speed factor 614 (e.g., 0.7×).

To transition back from the second speech factor 614 to the first speech factor 612, the server(s) 120 may repeat the process and transition from the second speech speed factor 614 (e.g., 0.7×) to the second intermediate speech speed factor 616*b* (e.g., 0.8×), from the second intermediate speech speed factor 616*b* to the first intermediate speech speed factor 616*a* (e.g., 0.9×), and from the first intermediate speech speed factor 616*a* to the first speech speed factor 612 (e.g., 1×).

While FIG. 6 illustrates the server(s) 120 transitioning back from the second speech speed factor 614 to the first speech speed factor 612, the disclosure is not limited thereto and the server(s) 120 may transition from the second speech speed factor 614 to a third speech speed factor without departing from the disclosure. For example, the server(s) 120 may determine a difference between the second speech speed factor 614 and the third speech speed factor and may transition based on the maximum transition value, as discussed above.

Figure 7:
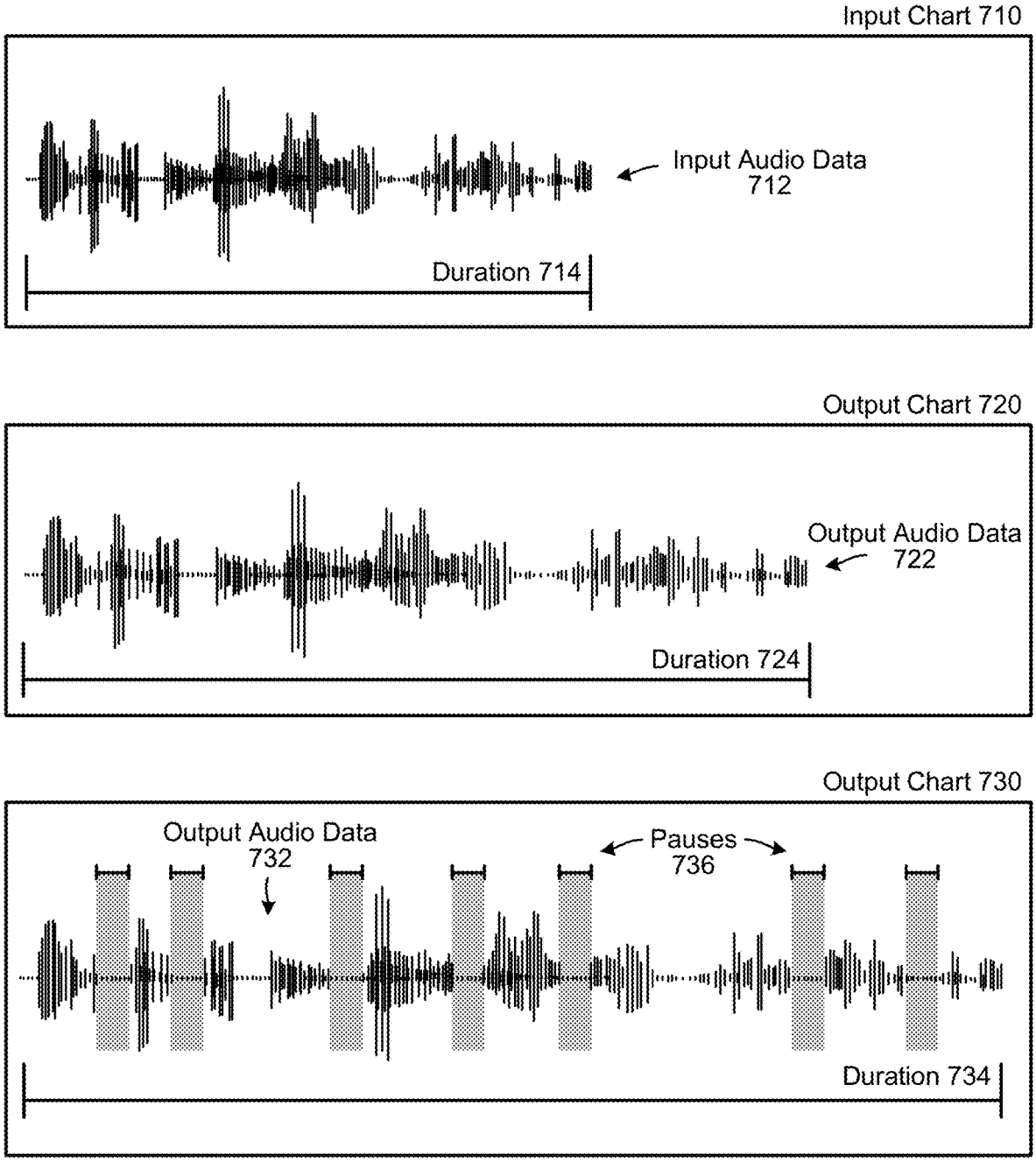
FIG. 7 illustrates examples of modifying a speech speed and inserting additional pauses in output audio data according to examples of the present disclosure.

FIG. 7 illustrates examples of modifying a speech speed and inserting additional pauses in output audio data according to examples of the present disclosure. As shown in FIG. 7, an input chart 710 illustrates input audio data 712 having a first duration 714. After performing voice normalization on and/or adjusting a speech speed of the input audio data 712, output chart 730 illustrates output audio data 722 having a second duration 724. As illustrated by the second duration 724, the server(s) 120 decreased a target speech speed relative to the original speech speed, such that a second speech speed associated with the output audio data 722 is slower than a first speech speed associated with the input audio data 712.

In addition to modifying the second speech speed associated with the output audio data, the server(s) 120 may also insert additional pauses in the input audio data 712. For example, output chart 730 illustrates output audio data 732 having a third duration 734, which is caused by inserting pauses 736. Thus, a third speech speed associated with the output audio data 732 is identical to the second speech speed associated with the output audio data 722, but the additional pauses 736 increase the third duration 734 relative to the second duration 724. The additional pauses 736 may provide a listener with additional time to understand and/or write down information included in the output audio data 732.

Figure 8A:
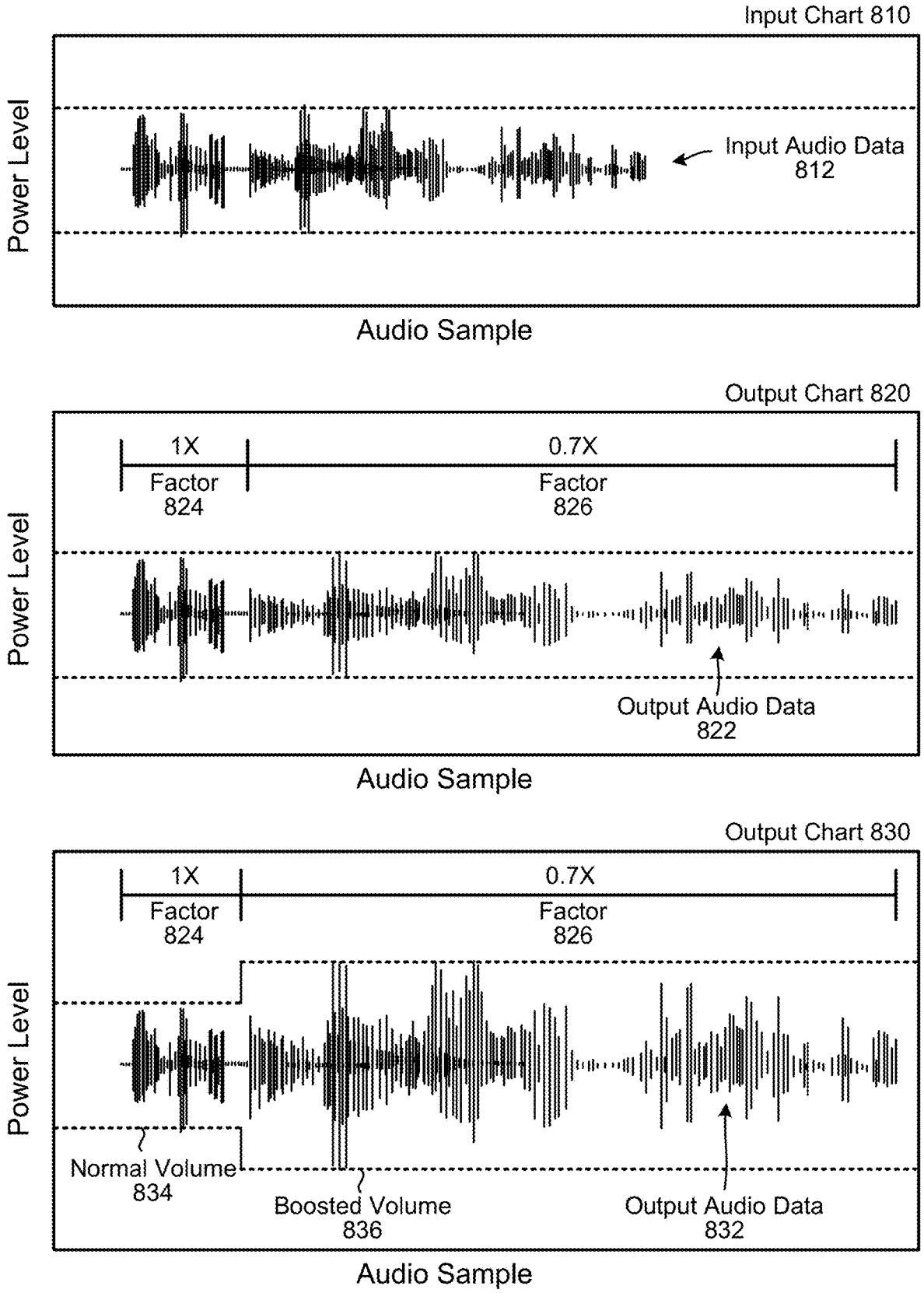
FIGS. 8A-8B illustrate examples of modifying a volume of input audio data in conjunction with modifying a speech speed according to examples of the present disclosure.
Figure 8B:
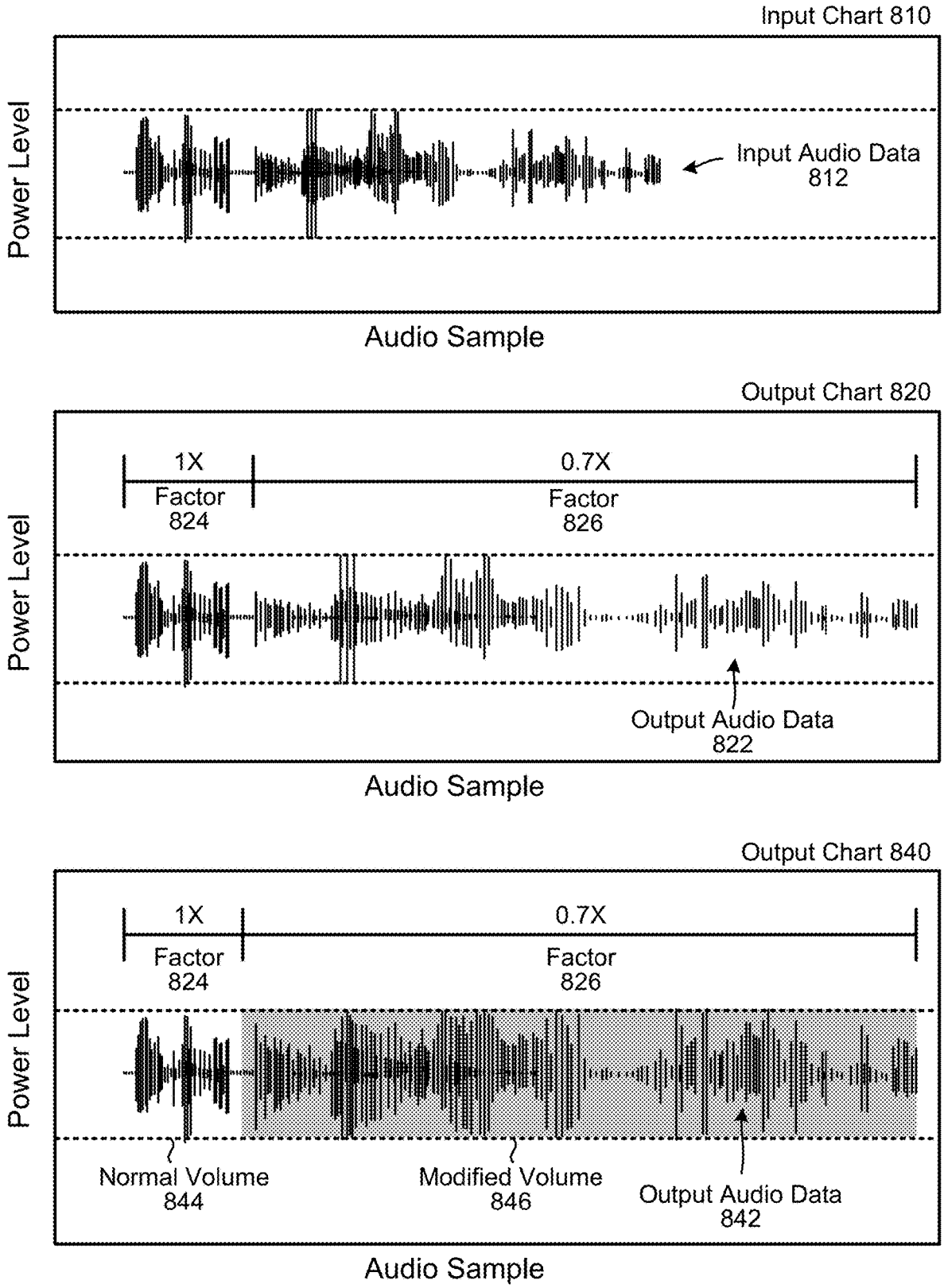

FIGS. 8A-8B illustrate examples of modifying a volume of input audio data in conjunction with modifying a speech speed according to examples of the present disclosure. FIG. 8A illustrates a first example of increasing (e.g., boosting) a volume level of a portion of the input audio data, such that a maximum volume level of the output audio data is greater than a maximum volume level of the input audio data. In contrast, FIG. 8B illustrates a second example of increasing (e.g., repairing) volume levels within the portion of the input audio data for individual words/sentences, such that a maximum volume level of the output audio data is identical to a maximum volume level of the input audio data but portions of the output audio data have a higher volume level than corresponding portions of the input audio data.

As shown in FIG. 8A, an input chart 810 illustrates input audio data 812 without a speech speed modification factor being applied. In contrast, output chart 820 illustrates output audio data 822 having a first speech speed modification factor 824 (e.g., 1×) applied to a first portion and a second speech speed modification factor 826 (e.g., 0.7×) applied to a second portion. Thus, a first speech speed associated with the first portion is identical to the input audio data (e.g., original speech speed), whereas a second speech speed associated with the second portion is decreased relative to the input audio data.

In addition to changing a speech speed, the server(s) 120 may also modify a volume level associated with the second portion. For example, output chart 830 illustrates output audio data 832 having the first speech speed modification factor 824 (e.g., 1×) applied to a first portion and the second speech speed modification factor 826 (e.g., 0.7×) applied to a second portion. In addition, the output audio data 832 has a normal volume level 834 associated with the first portion and a boosted volume level 836 associated with the second portion. The server(s) 120 may generate the boosted volume level 836 using a volume modification factor. For example, the server(s) 120 may determine the volume modification factor based on the second speech speed modification factor 826 and may apply the volume modification factor to the second portion of the input audio data. Thus, the volume is increased for the second portion in order to improve playback of the output audio data.

FIG. 8B illustrates the input chart 810 and the output chart 820, as discussed above with regard to FIG. 8A, as well as an output chart 840 that illustrates output audio data 842 having the first speech speed modification factor 824 (e.g., 1×) applied to a first portion and the second speech speed modification factor 826 (e.g., 0.7×) applied to a second portion. However, in contrast to the output audio data 832 that has a boosted volume level 836 associated with the second portion, the output audio data 842 has a normal volume level 844 associated with the first portion and a modified volume level 846 associated with the second portion.

The server(s) 120 may generate the modified volume level 846 using a volume modification factor and a maximum threshold value (e.g., maximum volume level). For example, the server(s) 120 may determine the volume modification factor based on the second speech speed modification factor 826 and may apply the volume modification factor to the second portion of the input audio data, with any volume levels above the maximum volume level being capped at the maximum volume level. Thus, instead of increasing a maximum volume level of the second portion, the server(s) 120 increase a volume level of individual words/sentences within the output audio data 842 to be closer to the maximum volume level. This removes variations in volume levels between words/sentences, which may be caused by variations in a volume of speech, variations in distance between a speaker and the microphone(s) 112, or the like. As a result of the modified volume 846, playback of the output audio data 842 may be improved and speech included in the output audio data 842 may be more reliably understood by the listener.

While the output chart 830 illustrates the server(s) 120 increasing a maximum volume level of the output audio data 832 and the output chart 840 illustrates the server(s) 120 increasing volume levels within the output audio data 842 to be closer to the maximum volume level, the disclosure is not limited thereto and the server(s) 120 may increase a maximum volume level of output audio data and increase volume levels within output audio data without departing from the disclosure.

Figure 9:
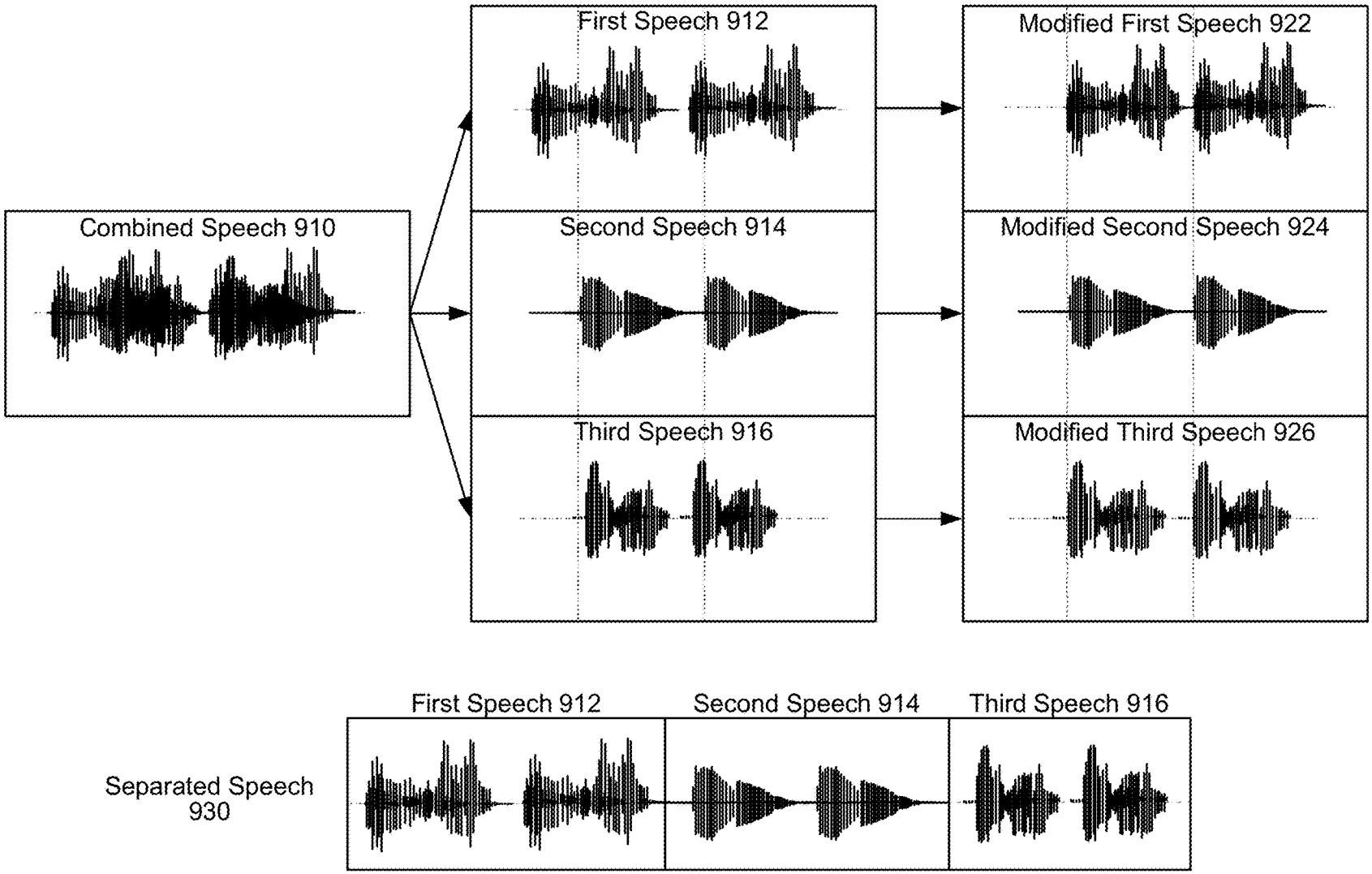
FIG. 9 illustrates an example of identifying speech from multiple users and applying different speech speed modification variables based on the user according to examples of the present disclosure.

FIG. 9 illustrates an example of identifying speech from multiple users and applying different speech speed modification factors based on the user according to examples of the present disclosure. As illustrated in FIG. 9, combined speech 910 may include speech associated with three different users. For example, the server(s) 120 may separate the combined speech 910 into first speech 912 associated with a first user, second speech 914 associated with a second user, and third speech 916 associated with a third user. After separating the first speech 912, the second speech 914, and the third speech 916, the server(s) 120 may perform voice normalization on and/or adjust a speech speed of each portion separately. For example, FIG. 9 illustrates modified first speech 922 associated with the first user, modified second speech 924 associated with the second user, and modified third speech 926 associated with the third user. As illustrated in FIG. 9, the server(s) 120 may determine target speech speeds in order to synchronize the modified first speech 922, the modified second speech 924 and the modified third speech 926. Thus, the server(s) 120 may adjust variations in speech speed so that a timing is uniform between the different users. This technique may be used for multiple applications, an example of which is synchronizing different singers to music and/or each other.

The server(s) 120 may synchronize the modified first speech 922, the modified second speech 924 and the modified third speech 926 (hereinafter, "modified speech") using several techniques. In some examples, the server(s) 120 may synchronize the modified speech by identifying shared words that are common to each of the modified speech. For example, if three users are singing a song or repeating the same phrase, the server(s) 120 may detect words that are repeated by each of the three users and use these words to synchronize the modified speech. Additionally or alternatively, the server(s) 120 may synchronize the modified speech based on a tempo of a song. For example, if the three users are singing a song with a specific tempo, the modified speech should share similar pauses or other timing and the server(s) 120 may align the modified speech based on a beat or other characteristic associated with the timing. However, the disclosure is not limited thereto and the server(s) 120 may align the modified speech using any technique known to one of skill in the art without departing from the disclosure.

In some examples, the server(s) 120 may separate the first speech 912, the second speech 914 and the third speech 916 into three separate sections and generate separated speech 930 that plays the three separate sections sequentially. For example, the combined speech 910 may correspond to audio data from a teleconference or the like, with multiple users speaking at the same time. While the combined speech 910 may be difficult to understand due to the overlapping speech, the separated speech 930 only includes speech associated with a single user at a time. Thus, the separated speech 930 may be more easily understood by the server(s) 120 and/or by a user.

Figure 10A:
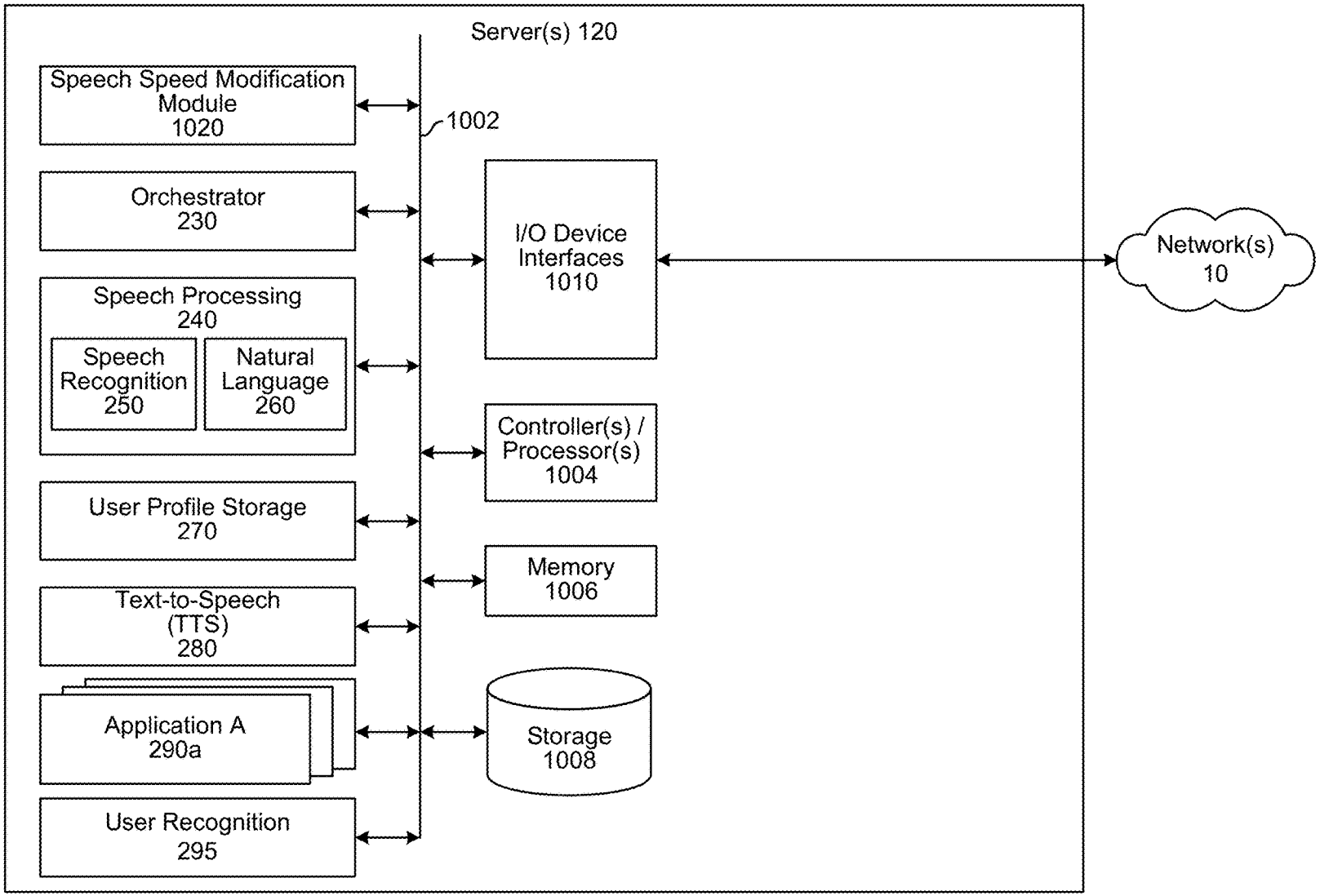
FIGS. 10A-10B are block diagrams conceptually illustrating example components of a system for voice enhancement according to embodiments of the present disclosure.
Figure 10B:
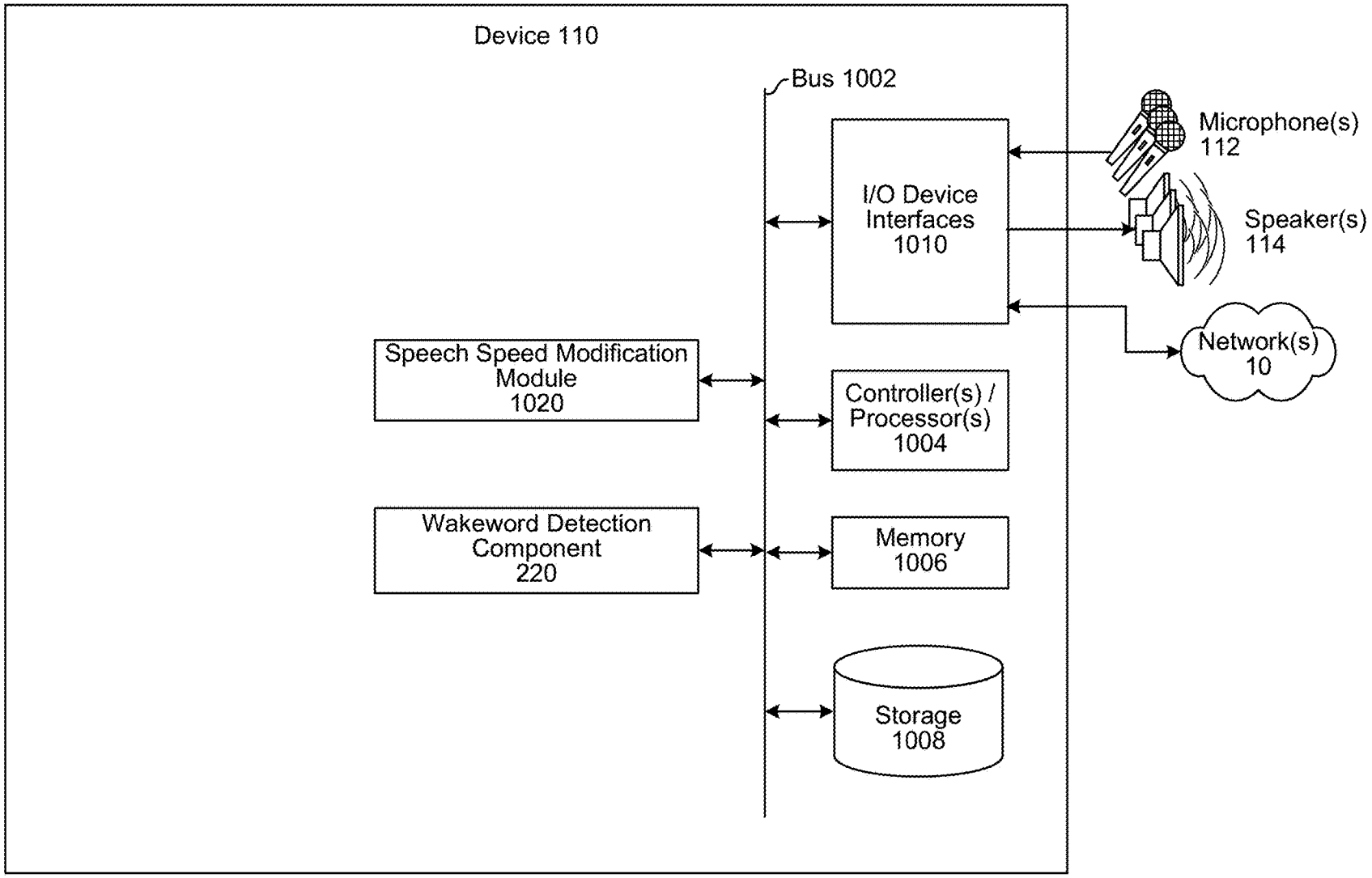

FIGS. 10A-10B are block diagrams conceptually illustrating example components of a system for voice enhancement according to embodiments of the present disclosure. In operation, the system 100 may include computer-readable and computer-executable instructions that reside on the device(s) 110/server(s) 120, as will be discussed further below.

The system 100 may include one or more audio capture device(s), such as microphone(s) 112 or an array of microphones 112. The audio capture device(s) may be integrated into the device 110 or may be separate.

The system 100 may also include an audio output device for producing sound, such as loudspeaker(s) 114. The audio output device may be integrated into the device 110 or may be separate.

As illustrated in FIGS. 10A-10B, the device(s) 110/server(s) 120 may include an address/data bus 1002 for conveying data among components of the device(s) 110/server(s) 120. Each component within the device(s) 110/server(s) 120 may also be directly connected to other components in addition to (or instead of) being connected to other components across the bus 1002.

The device(s) 110/server(s) 120 may include one or more controllers/processors 1004, that may each include a central processing unit (CPU) for processing data and computer-readable instructions, and a memory 1006 for storing data and instructions. The memory 1006 may include volatile random access memory (RAM), non-volatile read only memory (ROM), non-volatile magnetoresistive (MRAM) and/or other types of memory. The device(s) 110/server(s) 120 may also include a data storage component 1008, for storing data and controller/processor-executable instructions (e.g., instructions to perform the algorithm illustrated in FIGS. 1, 4A and/or 4B). The data storage component 1008 may include one or more non-volatile storage types such as magnetic storage, optical storage, solid-state storage, etc. The device(s) 110/server(s) 120 may also be connected to removable or external non-volatile memory and/or storage (such as a removable memory card, memory key drive, networked storage, etc.) through the input/output device interfaces 1010.

The device(s) 110/server(s) 120 includes input/output device interfaces 1010, such as the microphone(s) 112 and/or the speaker(s) 114. A variety of components may be connected through the input/output device interfaces 1010.

The input/output device interfaces 1010 may be configured to operate with network(s) 10, for example a wireless local area network (WLAN) (such as WiFi), Bluetooth, ZigBee and/or wireless networks, such as a Long Term Evolution (LTE) network, WiMAX network, 3G network, etc. The network(s) 10 may include a local or private network or may include a wide network such as the internet. Devices may be connected to the network(s) 10 through either wired or wireless connections.

The input/output device interfaces 1010 may also include an interface for an external peripheral device connection such as universal serial bus (USB), FireWire, Thunderbolt, Ethernet port or other connection protocol that may connect to network(s) 10. The input/output device interfaces 1010 may also include a connection to an antenna (not shown) to connect one or more network(s) 10 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc.

As discussed above with regard to FIG. 2, the server(s) 120 may include an orchestrator component 230, a speech processing component 240 (including a speech recognition component 250 and a natural language component 260), user profile storage 270, a text-to-speech (TTS) component 280, one or more application(s) 290 and/or a user recognition component 295, as illustrated in FIG. 10A. In addition, the device 110 may optionally include a wakeword detection component 220, as illustrated in FIG. 10B.

The device(s) 110/server(s) 120 may include a speech speed modification module 1020, which may comprise processor-executable instructions stored in storage 1008 to be executed by controller(s)/processor(s) 1004 (e.g., software, firmware, hardware, or some combination thereof). For example, components of the speech speed modification module 1020 may be part of a software application running in the foreground and/or background on the device(s) 110/server(s) 120. The speech speed modification module 1020 may control the device(s) 110/server(s) 120 as discussed above, for example with regard to FIGS. 1, 4A and/or 4B. Some or all of the controllers/components of the speech speed modification module 1020 may be executable instructions that may be embedded in hardware or firmware in addition to, or instead of, software. In one embodiment, the device(s) 110/server(s) 120 may operate using an Android operating system (such as Android 4.3 Jelly Bean, Android 4.4 KitKat or the like), an Amazon operating system (such as FireOS or the like), or any other suitable operating system.

Executable computer instructions for operating the device(s) 110/server(s) 120 and its various components may be executed by the controller(s)/processor(s) 1004, using the memory 1006 as temporary "working" storage at runtime. The executable instructions may be stored in a non-transitory manner in non-volatile memory 1006, storage 1008, or an external device. Alternatively, some or all of the executable instructions may be embedded in hardware or firmware in addition to or instead of software.

Multiple device(s) 110/server(s) 120 may be employed in a single system 100. In such a multi-device system, each of the device(s) 110/server(s) 120 may include different components for performing different aspects of the process. The multiple device(s) 110/server(s) 120 may include overlapping components. The components of the device(s) 110/server(s) 120, as illustrated in FIGS. 10-10B, are exemplary, and may be located a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, video game consoles, speech processing systems, distributed computing environments, etc. Thus the components, components and/or processes described above may be combined or rearranged without departing from the scope of the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Embodiments of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, comprising:

receiving input audio data representing a voice command;

determining an input speech speed corresponding to the input audio data;

determining output data responsive to the voice command;

determining first data associated with a user profile corresponding to the voice command, the first data representing an incoming communication request for the user profile;

determining a target output speed based at least in part on the input speech speed and the first data;

using the output data to generate output audio data representing output speech, the output speech corresponding to the target output speed; and causing a device to output the output audio data.

2. The computer-implemented method of claim 1, further comprising:

determining preference data corresponding to the voice command, the preference data representing at least one of a previously selected target output speed, a previously used target output speed, or location data associated with the preference data, and wherein the target output speed is determined further based at least in part on the preference data.

3. The computer-implemented method of claim 1, further comprising:

determining the target output speed corresponding to a first portion of the output data;

determining a second target output speed corresponding to a second portion of the output data; and wherein a first portion of the output speech corresponds to the target output speed and a second portion of the output speech corresponds to the second target output speed.

4. The computer-implemented method of claim 3, further comprising:

determining a difference between the target output speed and the second target output speed;

dividing the difference by a maximum transition value to determine a number of increments; and determining one or more intermediate target output speeds corresponding to a third portion of the output audio data, the third portion being between the first portion and the second portion, a number of the one or more intermediate target output speeds corresponding to the number of increments, wherein the first portion of the output speech corresponds to the target output speed, the second portion of the output speech corresponds to the second target output speed, and a third portion of the output speech corresponds to the one or more intermediate target output speeds.

5. The computer-implemented method of claim 1, further comprising:

determining an input volume level associated with the voice command;

determining a target volume level based at least in part on the input volume level; and associating the target volume level with the output audio data.

6. The computer-implemented method of claim 1, wherein:

the voice command includes a command to play a voice message;

the output data represents audio data corresponding to the voice message;

the method further comprises determining a message speech speed associated with the output data; and determining the target output speed comprises determining the target output speed based at least in part on the input speech speed and the message speech speed.

7. The computer-implemented method of claim 6, further comprising:

determining a first user profile corresponding to the voice command;

determining first preference data associated with the first user profile, the first preference data indicating at least one of a previously selected target output speed, a previously used target output speed, or location data associated with the first user profile;

determining a second user profile corresponding to the voice message; and determining second preference data associated with the second user profile, the second preference data indicating at least one of a preferred output speed for the voice message, wherein determining the target output speed comprises determining the target output speed based at least in part on one of the input speech speed, the message speech speed, the first preference data or the second preference data.

8. The computer-implemented method of claim 6, wherein:

the output data includes a representation of first speech associated with a first user profile and a representation of second speech associated with a second user profile, wherein the message speech speed is associated with the first speech and the target output speed is associated with the first speech, and the method further comprises:

determining a second message speech speed associated with the second speech;

determining a second target output speed corresponding to the second speech; and using the output data to generate the output audio data representing the output speech, a first portion of the output speech corresponding to the target output speed and a second portion of the output speech corresponding to the second target output speed.

9. The computer-implemented method of claim 1, further comprising:

determining playback speed preferences associated with the user profile;

determining configuration data corresponding to information about at least one of the user profile or the voice command;

determining quality data corresponding to an audio quality of the output data, and wherein determining the target output speed comprises determining the target output speed based at least in part on one of the input speech speed, the configuration data, the playback speed preferences, or the quality data.

10. The computer-implemented method of claim 1, further comprising:

determining a plurality of positions in the output data in which to insert a duration of silence, the plurality of positions including a first position; and generating the output audio data using the output data, the output audio data including the duration of silence at the first position.

11. A system comprising:

at least one processor; and memory including instructions operable to be executed by the at least one processor to configure the system to:

receive input audio data representing a voice command;

determine an input speech speed corresponding to the input audio data;

determine output data responsive to the voice command;

determine quality data corresponding to an audio quality of the output data;

determine a target output speed based at least in part on the input speech speed and the quality data;

using the output data, generate output audio data representing output speech, the output speech corresponding to the target output speed; and cause a device to output the output audio data.

12. The system of claim 11, wherein the memory further includes instructions that, when executed, further configure the system to:

determine a user profile corresponding to the voice command;

determine first data corresponding to the voice command, the first data representing at least one of a previously selected target output speed, a previously used target output speed, or location data associated with the user profile, and wherein the target output speed is determined further based at least in part on the first data.

13. The system of claim 11, wherein the memory further includes instructions that, when executed, further configure the system to:

determine urgency data associated with a user profile corresponding to the voice command, the urgency data representing at least one of location data associated with the user profile, calendar data associated with the user profile, or incoming communication data associated with the user profile, and wherein the target output speed is determined further based on at least in part the urgency data.

14. The system of claim 11, wherein the memory further includes instructions that, when executed, further configure the system to:

determine the target output speed corresponding to a first portion of the output data;

determine a second target output speed corresponding to a second portion of the output data;

wherein a first portion of the output speech corresponds to the target output speed and a second portion of the output speech corresponds to the second target output speed.

15. The system of claim 14, wherein the memory further includes instructions that, when executed, further configure the system to:

determine a difference between the target output speed and the second target output speed;

divide the difference by a maximum transition value to determine a number of increments;

determine one or more intermediate target output speeds corresponding to a third portion of the output audio data, the third portion being between the first portion and the second portion, a number of the one or more intermediate target output speeds corresponding to the number of increments; and wherein the first portion of the output speech corresponds to the target output speed, the second portion of the output speech corresponds to the second target output speed, and a third portion of the output speech corresponds to the one or more intermediate target output speeds.

16. The system of claim 11, wherein the memory further includes instructions that, when executed, further configure the system to:

determine an input volume level associated with the voice command;

determine a target volume level based at least in part on the input volume level;

associate the target volume level with the output audio data.

17. The system of claim 11, wherein:

the voice command includes a command to play a voice message, the output data represents audio data corresponding to the voice message, the memory further includes instructions that, when executed, further configure the system to determine a message speech speed associated with the audio data, and the instruction to determine the target output speed further configures the system to determine the target output speed based at least in part on the input speech speed and the message speech speed.

18. The system of claim 11, wherein the memory further includes instructions that, when executed, further configure the system to:

determine a user profile corresponding to the voice command;

determine configuration data corresponding to information about at least one of the user profile or the voice command; and determine a stored output speed preference represented in the user profile, wherein the instructions that configure the system to determine the target output speed further configure the system to determine the target output speed based at least in part on one of the input speech speed, the stored output speed preference, the configuration data, or the quality data.

19. The system of claim 17, wherein the memory further includes instructions that, when executed, further configure the system to:

determine a first user profile corresponding to the voice command;

determine first preference data associated with the first user profile, the first preference data indicating at least one of a previously selected target output speed, a previously used target output speed, or location data associated with the first user profile;

determine a second user profile corresponding to the voice message; and determine second preference data associated with the second user profile, the second preference data indicating at least one of a preferred output speed for the voice message, and wherein the instructions that configure the system to determine the target output speed further configure the system to determine the target output speed based at least in part on one of the input speech speed, the message speech speed, the first preference data or the second preference data.

* * * * *